US008272640B2

(12) United States Patent
Yamamoto et al.

(10) Patent No.: US 8,272,640 B2
(45) Date of Patent: Sep. 25, 2012

(54) MEDIUM CONVEYANCE APPARATUS WHICH ADOPTS DISTRIBUTED CONTROL SYSTEM

(75) Inventors: Satoru Yamamoto, Abiko (JP); Keita Takahashi, Abiko (JP); Atsushi Otani, Moriya (JP); Shoji Takeda, Tokyo (JP); Hirotaka Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/033,846

(22) Filed: Feb. 24, 2011

(65) Prior Publication Data

US 2011/0241289 A1 Oct. 6, 2011

(30) Foreign Application Priority Data

Mar. 31, 2010 (JP) ..... 2010-083398

(51) Int. Cl.
*B65H 7/02* (2006.01)
*B65H 5/34* (2006.01)

(52) U.S. Cl. ..... 271/265.01; 271/270

(58) Field of Classification Search ..... 271/265, 271/265.01, 266, 270, 176, 272
See application file for complete search history.

(56) References Cited

FOREIGN PATENT DOCUMENTS

JP 2001147706 A 5/2001

*Primary Examiner* — Kaitlin Joerger
*Assistant Examiner* — Patrick Cicchino
(74) *Attorney, Agent, or Firm* — Fitzpatrick, Cella, Harper & Scinto

(57) ABSTRACT

A first lower layer control unit controls a conveyance unit, that conveys the medium in a first conveyance section of a conveyance path. A second lower layer control unit controls a conveyance unit, that conveys the medium in a second conveyance section located downstream of the first conveyance section. An upper layer control unit determines whether the medium is at a position where both the first lower layer control unit and the second lower layer control unit engage with conveyance control of the medium, instructs the first lower layer control unit and the second lower layer control unit to operate in synchronization with each other when the medium is at the position, and instructs the second lower layer control unit to operate asynchronously to the first lower layer control unit when the medium is not at the position.

6 Claims, 22 Drawing Sheets

FIG. 5B

| SUB-MASTER | SLAVE | ID | PASS LENGTH | REFERENCE SENSOR | SENSOR DISTANCE | MOTOR ID | MOTOR | ROLLER DISTANCE | ENTRANCE POSITION | EXIT POSITION |
|---|---|---|---|---|---|---|---|---|---|---|
| SUB-MASTER CPU 601 | SLAVE CPU 602 | 1 | 40 | SENSOR 247 | 20 | 1 | MOTOR 606 (ROLLER 238) | 0 | 0 | 40 |
| | SLAVE CPU 605 | 2 | 220 | SENSOR 256 | 200 | 2 | MOTOR 609 (ROLLER 237) | 20 | 40 | 260 |
| | | | | | | 3 | MOTOR 610 (ROLLER 236) | 60 | | |
| | | | | | | 4 | MOTOR 611 (ROLLER 235) | 120 | | |
| SUB-MASTER CPU 701 | SLAVE CPU 706 | 1 | 120 | - | - | 1 | - | 120 | 260 | 380 |
| SUB-MASTER CPU 801 | SLAVE CPU 802 | 1 | 120 | - | - | 1 | - | 60<br>120 | 380 | 500 |
| SUB-MASTER CPU 901 | SLAVE CPU 902 | 1 | 120 | SENSOR 269 | 20 | 1 | MOTOR 907 (ROLLER 270) | 100 | 500 | 620 |

FIG. 8A

| COMMAND TABLE | DIRECTION | SYNCHRO-NIZATION | CMD-ID | PARAMETER 1 | 2 | 3 | 4 |
|---|---|---|---|---|---|---|---|
| MOTOR START A | M → S | ○ | 0100h | MOTOR ID | VELOCITY | ACCELERATION | CURRENT VALUE |
| MOTOR START B | M → S | × | 0110h | MOTOR ID | VELOCITY | ACCELERATION | CURRENT VALUE |
| MOTOR STOP A | M → S | ○ | 0200h | MOTOR ID | DECELERATION | NUMBER OF DELAYED PULSES | |
| MOTOR STOP B | M → S | × | 0210h | MOTOR ID | DECELERATION | NUMBER OF DELAYED PULSES | |
| MOTOR VELOCITY CHANGE A | M → S | ○ | 0300h | MOTOR ID | VELOCITY | ACCELERATION | NUMBER OF DELAYED PULSES |
| MOTOR VELOCITY CHANGE B | M → S | × | 0310h | MOTOR ID | VELOCITY | ACCELERATION | NUMBER OF DELAYED PULSES |
| SYNCHRONIZATION | M → S | – | 0500h | – | | | |
| SYNCHRONIZATION RESPONSE | S → M | – | 0600h | – | | | |
| SENSOR TURN-ON | S → M | – | 0900h | SENSOR ID | | | |
| SENSOR TURN-OFF | S → M | – | 0910h | SENSOR ID | | | |
| PULSE COUNTING | M → S | – | 0A00h | MOTOR ID | COUNT VALUE | | |
| COMPLETION OF PULSE COUNTING | S → M | – | 0B00h | MOTOR ID | | | |
| CANCELLATION OF PULSE COUNTING | S → M | – | 0C00h | MOTOR ID | | | |

TO FIG. 12B

MEDIUM CONVEYANCE APPARATUS WHICH ADOPTS DISTRIBUTED CONTROL SYSTEM

BACKGROUND OF THE INVENTION

1. Field of the Invention

The present invention relates to a medium conveyance apparatus which adopts a distributed control system.

2. Description of the Related Art

To control an image forming apparatus such as a printer or a copying machine, central control which uses a single CPU has conventionally been adopted. However, this control poses problems in that the concentration of control in a particular CPU increases its CPU load and increases the lengths of bundled lines routed to a load driver unit spaced apart from a control CPU board. To solve such problems, a distributed control system in which each control module constituting the image forming apparatus is divided into individual sub-CPUs is attracting a great deal of attention. In the distributed control system, a plurality of control modules which are arranged to be distributed operate in cooperation with each other while sending/receiving, for example, pieces of control information and commands.

In the field of robot arms, a distributed control system has already been proposed (Japanese Patent Laid-Open No. 2001-147706). The distributed control system is built using a plurality of sub-control CPUs for controlling a plurality of arm joint actuators, and a main control CPU for supervising their cooperative control. Control data for cooperative control is supplied from the main control CPU to the sub-control CPUs via a network in advance, and the sub-control CPUs drive the actuators, respectively, based on the control data in synchronization with a common clock signal from a clock supply unit.

Unfortunately, the technique described in Japanese Patent Laid-Open No. 2001-147706 poses the following problems. For example, because a robot arm etc. must have fast response characteristics, the modules are connected to each other via a high-speed network. The cooperative control includes, for example, feedback control implemented by allowing, for example, a distance measurement/detection control module which detects its distance from an object gripped by the arm and an actuator control module to work with each other. The distance measurement/detection control module notifies the main control CPU of the detected amount. The main control CPU supplies control data to the sub-control CPUs of each actuator control module. Moreover, the main control CPU notifies each sub-control CPU of a synchronizing clock. To obtain fast response characteristics in the feedback control, the overhead on the network is non-negligible. This makes a high-speed network necessary.

However, the cost rises upon applying a high-speed network to distributed control of the image forming apparatus. On the other hand, a plurality of conveyance rollers are provided in the conveyance path of a medium (paper sheet), and different sub-CPUs control these conveyance rollers for respective conveyance sections. This makes it necessary to transfer a medium among the plurality of sub-CPUs. If the plurality of sub-CPUs cannot obtain timing synchronization, the medium may suffer tension or looping (slack), leading to a paper jam. Nevertheless, a conveyance section in which the plurality of sub-CPUs may perform asynchronous conveyance control is also available, depending on the size of the medium.

SUMMARY OF THE INVENTION

In view of this, it is a feature of the present invention to solve at least one of the foregoing and other problems. For example, it is a feature of the present invention to implement distributed control which uses a plurality of control units without raising the cost in a medium conveyance apparatus. Other problems and their solutions are explained throughout the specification.

The present invention provides a medium conveyance apparatus comprising: a conveyance path to convey a medium; a plurality of conveyance units which convey the medium along the conveyance path; a first lower layer control unit which controls a conveyance unit, that conveys the medium in a first conveyance section of the conveyance path, among the plurality of conveyance units; a second lower layer control unit which controls a conveyance unit, that conveys the medium in a second conveyance section located downstream of the first conveyance section in a direction in which the medium is conveyed, among the plurality of conveyance units; an upper layer control unit which controls the first lower layer control unit and the second lower layer control unit; and a passage detection unit which is provided in the conveyance path, and detects passage of the medium, wherein the upper layer control unit is further configured to: determine, in accordance with the detection result obtained by the passage detection unit, whether the medium is at a position where both the first lower layer control unit and the second lower layer control unit engage with conveyance control of the medium; instruct the first lower layer control unit and the second lower layer control unit to operate in synchronization with each other when the upper layer control unit determines that the medium is at the position where both the first lower layer control unit and the second lower layer control unit engage with the conveyance control of the medium; and instruct the second lower layer control unit to operate asynchronously to the first lower layer control unit when the upper layer control unit determines that the medium is not at the position where both the first lower layer control unit and the second lower layer control unit engage with the conveyance control of the medium.

Further features of the present invention will become apparent from the following description of exemplary embodiments with reference to the attached drawings.

BRIEF DESCRIPTION OF THE DRAWINGS

FIG. 5B is a table showing a data holding structure associated with conveyance passes;

FIG. 8A is a table showing the command format;

DESCRIPTION OF THE EMBODIMENTS

First Embodiment

Figure 1:
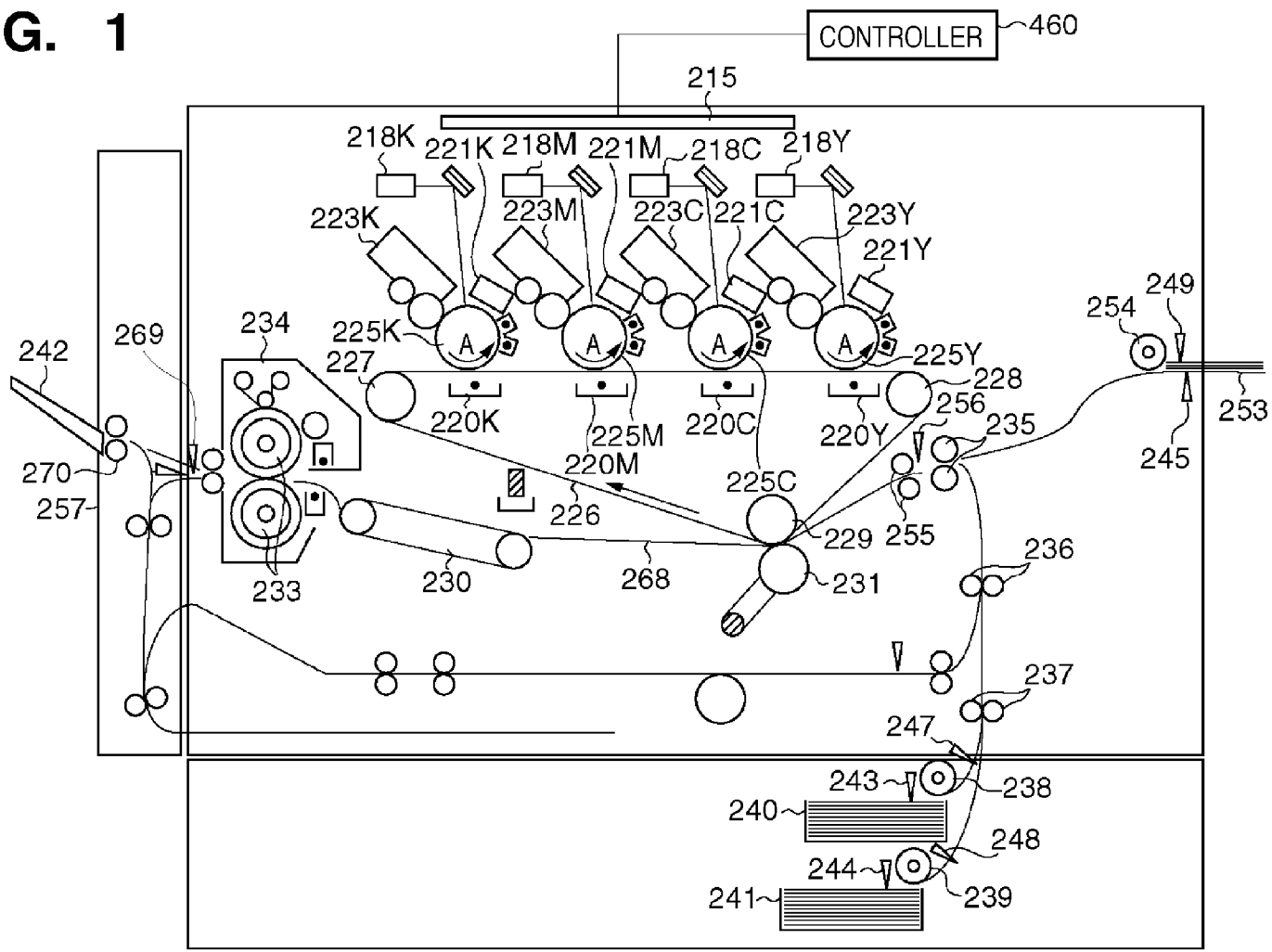
FIG. 1 is a sectional view illustrating an example of the arrangement of an image forming apparatus.

In general, the conveyance path of a paper sheet is logically divided into a plurality of sections. In other words, the conveyance path of a paper sheet includes a section in which a certain slave CPU takes charge of conveyance control of the paper sheet and that in which another slave CPU takes charge of conveyance control of the paper sheet. Hence, a plurality of slave CPUs simultaneously engage with conveyance of a single paper sheet at the boundary between adjacent sections. In this case, the plurality of slave CPUs must operate in synchronization with each other.

Under these circumstances, in the present invention, a plurality of slave CPUs are operated synchronously or asynchronously to each other in accordance with whether they simultaneously engage with conveyance control of a single paper sheet to stop its conveyance. For example, depending on the size and position of a medium in the conveyance path, a plurality of slave CPUs must operate in synchronization with each other in some cases, while they must be able to operate asynchronously to each other in other cases. The present invention has been made by focusing attention on this fact, and reduces the communication traffic in the communication path. This makes it possible to adopt an inexpensive communication path.

In general, to allow the plurality of slave CPUs to operate in synchronization with each other, a command for issuing a synchronous conveyance instruction, a response to this command, and a command for sending information on the synchronization timing, for example, must be communicated between each slave CPU which engages with conveyance and a sub-master CPU. On the other hand, to convey a medium with a size that can be conveyed asynchronously, a command for issuing an asynchronous conveyance instruction need only be sent to a slave CPU which engages with conveyance.

For the sake of reference, a medium (for example, an A3-size medium) with a size (a length in its conveyance direction) that extends across a plurality of conveyance sections, which undergo conveyance control by different slave CPUs, requires synchronous conveyance. Normally, the frequency of usage of such a long medium is low, so that of synchronous conveyance is also low. On the other hand, even in conveying a relatively short paper sheet, a plurality of slave CPUs often must simultaneously engage with its conveyance control at some points, depending on its position in the conveyance path.

Nevertheless, a plurality of slave CPUs must simultaneously engage with conveyance control at only a few points. Especially the position where conveyance of the paper sheet stops is rarely such a point.

In this manner, the communication traffic can be greatly reduced as a whole by operating a plurality of slave CPUs synchronously or asynchronously to each other in accordance with whether they simultaneously engage with conveyance control of a single paper sheet to stop its conveyance. This would obviate the need for a high-speed network.

Although a medium conveyance apparatus built into an image forming apparatus will be taken as an example herein, the present invention may be applied to a medium conveyance apparatus used for an apparatus other than an image forming apparatus. This is because a feature of the present invention lies in that synchronous conveyance and asynchronous conveyance are switched from one to the other in accordance with the size of a medium, so the present invention is independent of image formation.

<Arrangement of Image Forming Apparatus>

An image forming apparatus shown in FIG. 1 adopts an electrophotographic scheme as its image forming scheme. Note that the technical idea of the present invention is independent of the image forming scheme. Hence, the present invention is also applicable to an inkjet scheme, a thermal transfer scheme, and other image forming schemes. Alphabetical suffixes Y, M, C, and K added to reference numerals indicate yellow, magenta, cyan, and black toners, respectively. Hence, alphabetical suffixes Y, M, C, and K will be omitted in explaining details common to each toner. Alphabetical suffixes Y, M, C, and K will be added to reference numerals in explaining details unique to each toner.

A photosensitive drum (to be referred to as a "photosensitive member 225" hereinafter) rotates in a direction indicated by an arrow A using a motor. A primary charging unit 221, exposure unit 218, developing unit 223, and transferring unit 220 are arranged around the photosensitive member 225. A developing unit 223K is used for monochrome development, and develops a latent image on a photosensitive member 225K using K toner. Developing units 223Y, 223M, and 223C are used for full-color development. The developing units 223Y, 223M, and 223C develop latent images on photosensitive members 225Y, 225M, and 225C using Y, M, and C toners, respectively. The toner images which have the respective colors and are developed on the photosensitive members 225 undergo multiple transfer onto a transferring belt 226, serving as an intermediate transferring member, at once by the transferring unit 220.

The transferring belt 226 is suspended across rollers 227, 228, and 229. The roller 227 functions as a driving roller which drives the transferring belt 226 upon being connected to a driving source. The roller 228 functions as a tension roller which adjusts the tension of the transferring belt 226. The roller 229 functions as a backup roller for a secondary transferring roller 231.

Paper sheets stored in paper feeding cassettes 240 and 241, and a manual paper feeding unit 253, are fed to the nip portion, that is, the butting portion between the secondary transferring roller 231 and the transferring belt 226 by a registration roller pair 255, a paper feeding roller pair 235, and vertical pass roller pairs 236 and 237. The paper sheet typifies a medium to be conveyed, and is sometimes called, for example, recording paper or a recording material. Also, the paper sheet need not always be a medium made of paper. The toner image formed on the transferring belt 226 is transferred onto the paper sheet in this nip portion. After that, the paper sheet onto which the toner image is transferred undergoes thermal fixing of the toner image by a fixing unit 234 and is discharged outside the apparatus. The paper feeding cassettes 240 and 241 and manual paper feeding unit 253 include sheet absence detection sensors 243, 244, and 245, respectively, for detecting the presence/absence of paper sheets. The paper feeding cassettes 240 and 241 and manual paper feeding unit 253 also include paper feed sensors 247, 248, and 249, respectively, for detecting pickup failures of paper sheets. The paper feed sensor 247 exemplifies a first sensing unit which senses passage of the leading and trailing edges of a medium (paper sheet) conveyed in a first conveyance section.

An image forming operation by the image forming apparatus will be described herein. When image formation starts, the paper sheets stored in the paper feeding cassettes 240 and 241 and manual paper feeding unit 253 are conveyed to the paper feeding roller pair 235 one by one by pickup rollers 238, 239, and 254, respectively. When the paper sheet is conveyed onto the registration roller pair 255 by the paper feeding roller pair 235, its passage is detected by a registration sensor 256 immediately preceding the registration roller pair 255. The registration sensor 256 exemplifies a second sensing unit which senses passage of the leading and trailing edges of the medium conveyed in a second conveyance section. The paper feeding roller pair 235 interrupts its conveyance operation for the paper sheet a predetermined time after passage of the paper sheet is detected by the registration sensor 256. As a result, the paper sheet abuts against the registration roller pair 255 at a standstill and stops. By starting the registration roller pair 255, the paper sheet is supplied onto the secondary transferring roller 231. Note that the registration roller pair 255 is connected to a driving source and receives a driving force transmitted from a clutch, thereby being driven rotationally.

A voltage is applied to the primary charging unit 221 to uniformly negatively charge the surface of the photosensitive member 225 at a predetermined charging unit potential. The image portion on the charged photosensitive member 225 is exposed to light by the exposure unit 218 including a laser scanner unit so as to have a predetermined exposure unit potential, thereby forming a latent image. The exposure unit 218 turns on/off laser light based on image data sent from a main controller 460 via a printer control I/F 215, thereby forming a latent image corresponding to an image of this data. A developing roller of the developing unit 223 is applied with a developing bias set in advance for each color. The latent image is developed with toner upon passing through the position of the developing roller, thereby being visualized as a toner image. After the toner image is transferred onto the transferring belt 226 by the transferring unit 220, and is further transferred by the secondary transferring roller 231 onto the paper sheet conveyed by the paper feeding unit, the paper sheet passes through a post-registration conveyance pass 268, and is conveyed to the fixing unit 234 via a conveyance belt 230. The paper sheet is discharged to a paper discharge tray 242 by paper discharge rollers 270 of a paper discharge unit 257. A paper discharge sensor 269 is provided at a position downstream of the fixing unit 234 in the conveyance direction.

In this manner, in this embodiment, a plurality of conveyance units are provided along a conveyance path to convey a medium. In particular, the section from the sheet absence detection sensor 243 to the paper feed sensor 247 exemplifies the first conveyance section in the conveyance path. Also, the section from the roller 237 to the registration roller pair 255 exemplifies the second conveyance section located downstream of the first conveyance section in the direction in which the medium is conveyed. The post-registration conveyance pass 268 and the paper discharge pass which are present downstream of the second conveyance section exemplify such conveyance sections.

Figure 2:
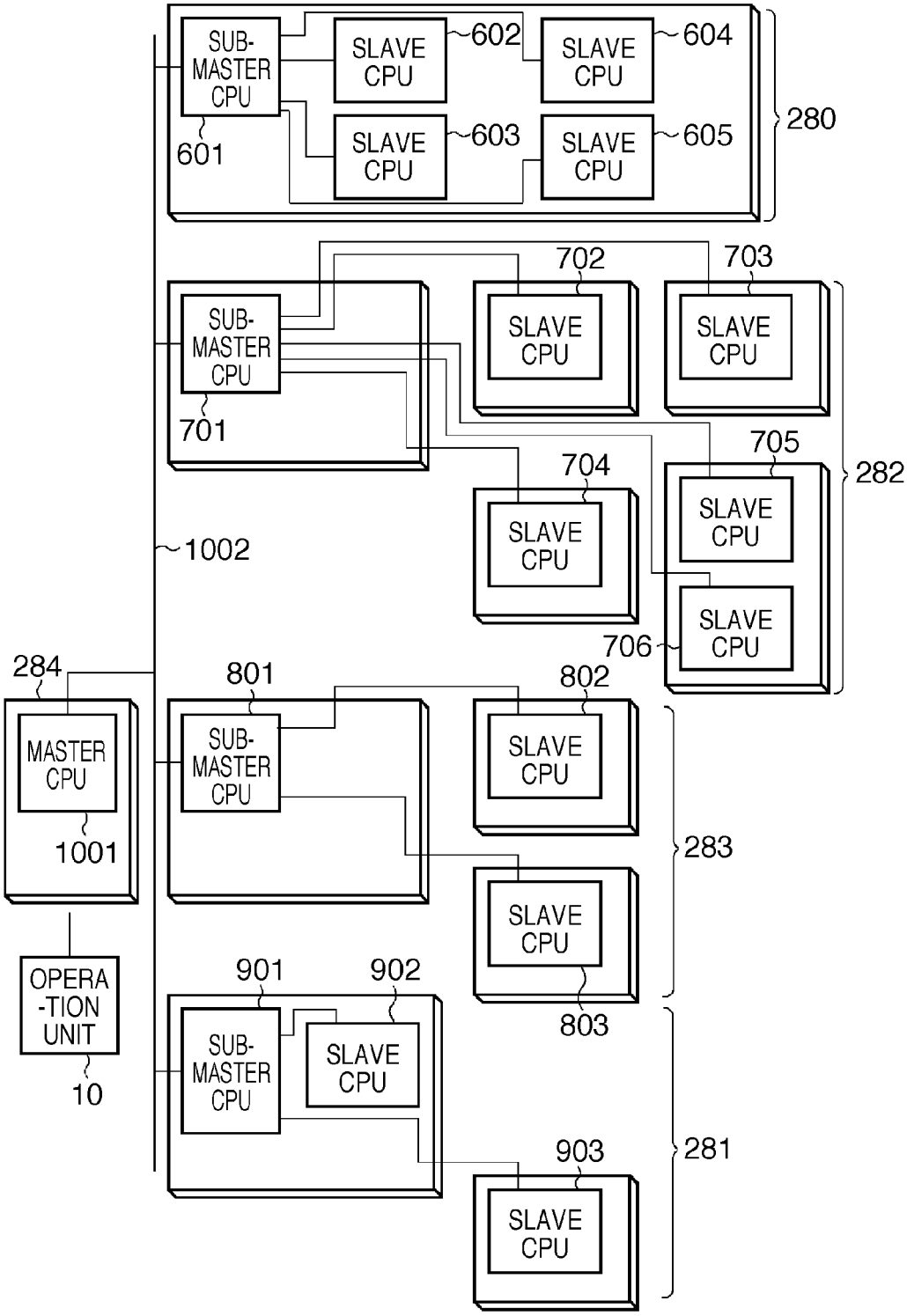
FIG. 2 is a block diagram illustrating an example of a control board of the image forming apparatus.

Each control load shown in FIG. 1 is controlled by four control blocks: a first conveyance module 280, second conveyance module 281, image formation module 282, and fixing module 283 shown in FIG. 2. A master module 284 serves as a control module for causing these four control blocks to function as an image forming apparatus. The master module 284 is provided with a master CPU 1001 serving as a master control unit/first lower layer control unit. The master CPU 1001 controls the overall image forming apparatus based on instructions, commands, and image data which are received from the main controller 460 via the printer control I/F 215. The first conveyance module 280, second conveyance module 281, image formation module 282, and fixing module 283 for executing image formation include sub-master CPUs 601, 901, 701, and 801, respectively as sub-master control units/second lower layer control units which control respective functions. The sub-master CPUs 601, 901, 701, and 801 are controlled by the master CPU 1001. The respective function modules also include slave CPUs 602, 603, 604 and 605, 902 and 903, 702, 703, 704, 705, and 706, and 802 and 803, respectively, as slave control units/third layer control units which operate the control loads for executing respective functions. The slave CPUs 602, 603, 604, and 605 are controlled by the sub-master CPU 601. The slave CPUs 902 and 903 are controlled by the sub-master CPU 901. The slave CPUs 702, 703, 704, 705, and 706 are controlled by the sub-master CPU 701. The slave CPUs 802 and 803 are controlled by the sub-master CPU 801.

As shown in FIG. 2, the master CPU 1001 is connected to the plurality of sub-master CPUs 601, 701, 801, and 901 via a common network communication bus (a main bus 1002). The sub-master CPUs 601, 701, 801, and 901 are connected to each other via the main bus 1002 as well. Note that the master CPU 1001 may be connected to the plurality of sub-master CPUs 601, 701, 801, and 901 by ring connection. The sub-master CPU 601 is also connected to the plurality of slave CPUs 602, 603, 604, and 605 via serial communication lines in one-to-one correspondence. Similarly, the sub-master CPU 701 is connected to the slave CPUs 702, 703, 704, 705, and 706 via serial communication lines. The sub-master CPU 801 is connected to the slave CPUs 802 and 803 via serial communication lines. The sub-master CPU 901 is connected to the slave CPUs 902 and 903 via serial communication lines. Note that the serial communication lines are used for short-distance communication.

In contrast, the sub-master CPUs 601, 701, 801, and 901 and the master CPU 1001 perform only communication which requires no precise control timings and supervises a rough sequence of processing of an image forming operation. The master CPU 1001 issues instructions to start, for example, pre-image-formation processing, paper feeding, and post-image-formation processing to the sub-master CPUs 601, 701, 801, and 901. The master CPU 1001 also issues an instruction based on the mode (for example, a monochrome mode or a double-sided image forming mode), designated by the main controller 460, to the sub-master CPUs 601, 701, 801, and 901 before the start of image formation. The sub-master CPUs 601, 701, 801, and 901 perform only communication which does not require precise timing control. That is, the control of the image forming apparatus is divided into units of control which do not require precise timing control among the sub-master CPUs, and the sub-master CPUs control the respective units of control at precise timings. Thus, in the image forming apparatus, the modules can be connected to each other via the main bus 1002 which requires only a low speed and low cost by minimizing the communication traffic. A control board on which the master CPU, sub-master CPUs, and slave CPUs are mounted need not exactly be the same as that shown in FIG. 2, and can be changed according to circumstances in terms of their mounting.

<Control Sequence>

Figure 3:
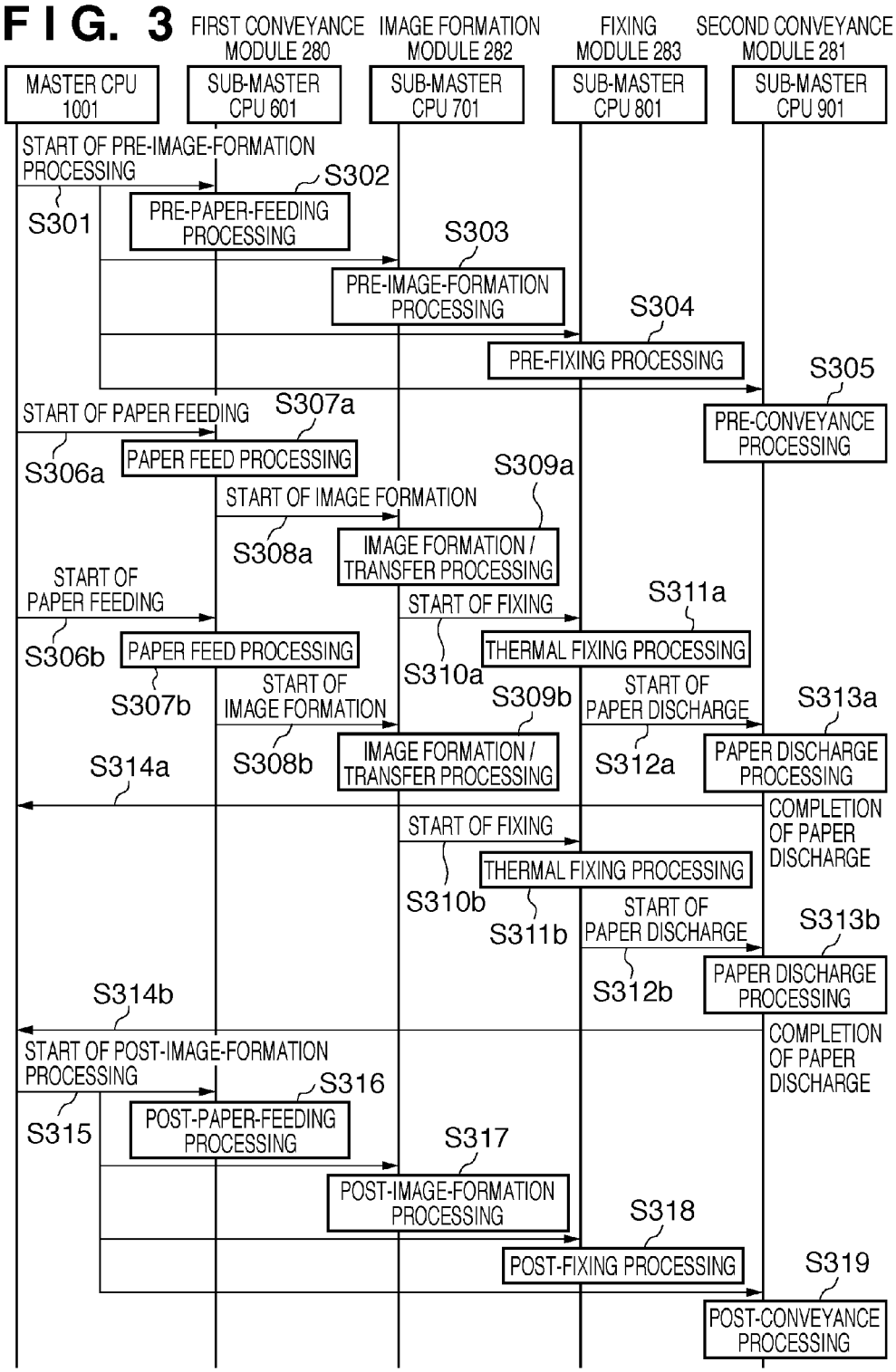
FIG. 3 is a sequence chart showing the control sequence of the image forming apparatus.

The control sequence of the image forming apparatus according to this embodiment will be described with reference to FIG. 3. A sequence chart shown in FIG. 3 assumes image formation on one paper sheet.

In step S301, the master CPU 1001 instructs the sub-master CPUs 601, 701, 801, and 901 to start pre-image-formation processing before the start of image formation. An example of the pre-image-formation processing of the conveyance modules is conveyance roller rotation processing for sensing any paper sheet remaining in the conveyance path. In step S302, in response to the start instruction, the sub-master CPU 601 executes pre-paper-feeding processing. In step S303, the sub-master CPU 701 executes pre-image-formation processing. In step S304, the sub-master CPU 801 executes pre-fixing processing. In step S305, the sub-master CPU 901 executes pre-conveyance processing.

In step S306*a*, the master CPU 1001 instructs the sub-master CPU 601 to start feeding of the first paper sheet in accordance with an instruction which is issued by the operator and input from an operation unit 10 or an external I/F. Note that the operation unit 10 includes an input unit and display unit, and is used to input information on the size of a paper sheet as a medium especially from the input unit to the master CPU 1001. In response to the paper feeding start instruction, the sub-master CPU 601 starts paper feed processing in step S307*a*. In the paper feed processing, the paper sheet placed in the paper feeding cassette 240 or 241 or manual paper feeding unit 253 is conveyed onto the registration roller pair 255, and temporarily stops at the current position. That is, the sub-master CPU 601 controls, for example, conveyance rollers provided along the conveyance path from the paper feeding cassettes 240 and 241 and manual paper feeding unit 253 to the registration roller pair 255. In step S308*a*, the sub-master CPU 601 restarts the registration roller pair 255 to convey the paper sheet onto the secondary transferring roller 231, and instructs the sub-master CPU 701 to start image formation. In response to the image formation start instruction, the sub-master CPU 701 executes image formation processing and transfer processing on the paper sheet in step S309*a*. In step S310*a*, the sub-master CPU 701 instructs the sub-master CPU 801 to start fixing when it is confirmed that the paper sheet on which an image is formed moves to the fixing unit 234. In response to the fixing start instruction, the sub-master CPU 801 executes thermal fixing processing on the paper sheet in step S311*a*. In step S312*a*, the sub-master CPU 801 instructs the sub-master CPU 901 to start paper discharge when it is confirmed that the paper sheet on which the image is fixed moves to the paper discharge rollers 270. In response to the paper discharge start instruction, the sub-master CPU 901 executes discharge processing for the paper sheet in step S313*a*. In step S314*a*, the sub-master CPU 901 notifies the master CPU 1001 that the paper discharge is complete.

In response to the notification of the paper discharge completion, the master CPU 1001 instructs the sub-master CPUs 601, 701, 801, and 901 to start post-image-formation processing in step S315. In response to the start instruction, the sub-master CPU 601 executes post-paper-feeding processing in step S316. In step S317, the sub-master CPU 701 executes post-image-formation processing. In step S318, the sub-master CPU 801 executes post-fixing processing. In step S319, the sub-master CPU 901 executes post-conveyance processing.

In the above-mentioned sequence, a series of image forming processing from feeding of a single paper sheet to its discharge has been explained. On the other hand, to continuously execute image formation on a plurality of paper sheets, image formation is continuously executed a predetermined time after the start of image formation of the first paper sheet, as shown in, for example, steps S306*b* to S314*b* in FIG. 3. In this case, the processes in steps S306*b* to S314*b* are repeatedly executed in accordance with the number of paper sheets.

<Configuration of First Conveyance Module 280>

The sub-master CPU 601 and slave CPUs 602 and 605 in the first conveyance module 280 that is especially closely related to this embodiment will be described herein. The first conveyance module 280 governs paper feeding control so that the paper sheets stored in the paper feeding cassettes 240 and 241 and manual paper feeding unit 253 are fed to the butting portion between the secondary transferring roller 231 and the transferring belt 226. The first conveyance module 280 includes the sub-master CPU 601 which performs overall control of the paper feeding control, and the slave CPUs 602, 603, 604, and 605 which drive control loads. Each slave CPU is connected to a control load group to be directly controlled by it.

Figure 4:
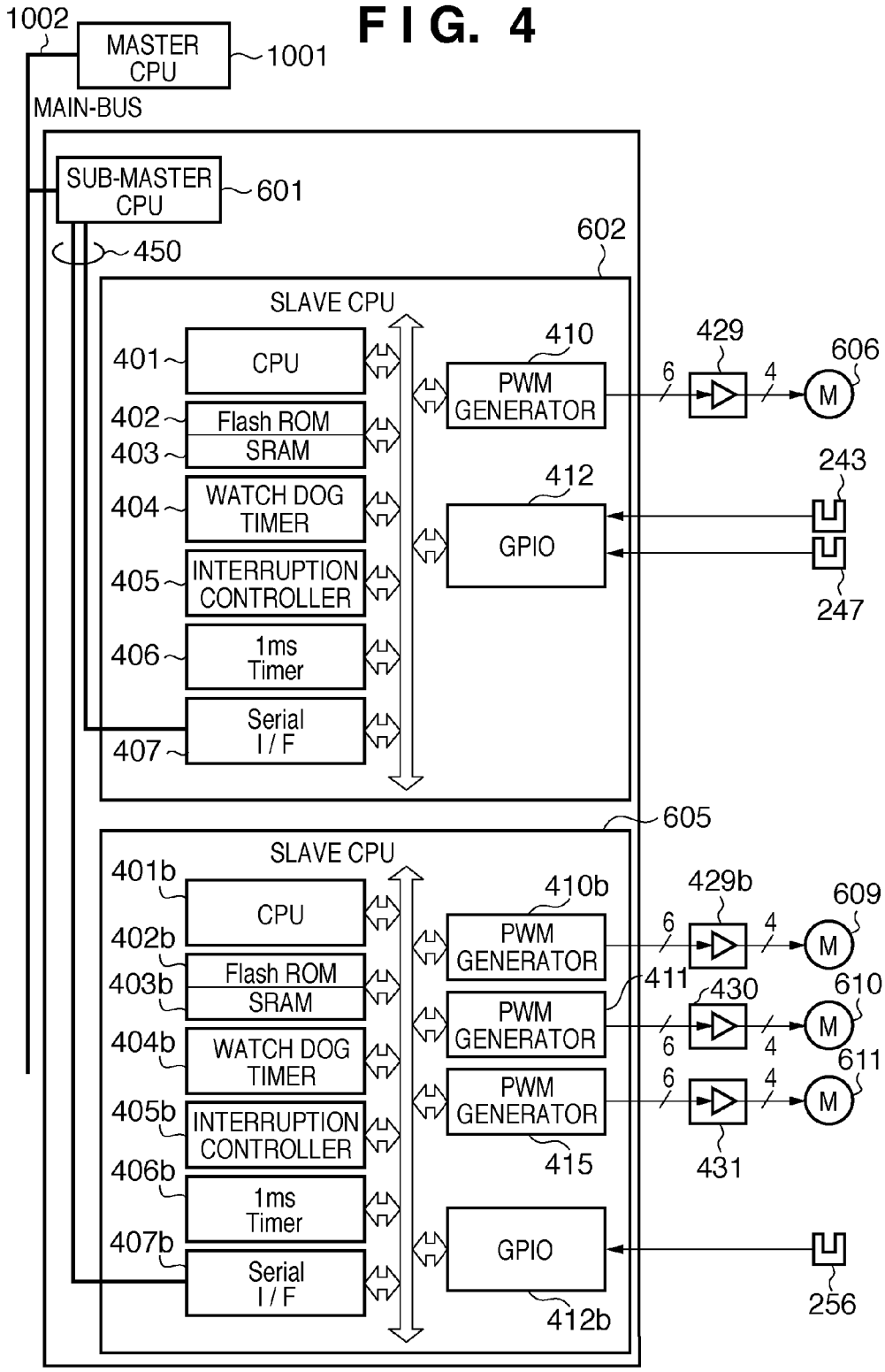
FIG. 4 is a control block diagram of a sub-master CPU 601.

FIG. 4 shows the internal structures and device connection relationships of the slave CPUs 602 and 605. Note that the slave CPUs 602 and 605 include identical or similar constituent elements, and reference numerals with suffixes "b" in the latter denote the same configurations as those in the former to avoid a repetitive description thereof. The slave CPU 602 has, as control loads, a motor 606 serving as a driving source for driving the pickup roller 238 associated with the paper feeding cassette 240, the sheet absence detection sensor 243 and paper feed sensor 247, and controls them so that the paper sheet is transferred to a paper feed pass 266. The pickup roller 238 and motor 606 exemplify a conveyance unit which conveys the medium in the first conveyance section. The slave CPU 605 has, as control loads, motors 609, 610, and 611 serving as driving sources for driving the paper feeding roller pair 235 and vertical pass roller pairs 236 and 237, and the registration sensor 256. The slave CPU 605 controls these control loads so that the paper sheets transferred from the paper feeding cassettes 240 and 241 and manual paper feeding unit 253 are conveyed onto the registration roller pair 255, and temporarily stop. The paper feeding roller pair 235, vertical pass roller pairs 236 and 237, and motors 609, 610, and 611 exemplify a conveyance unit which conveys the medium in the second conveyance section. The sheet absence detection sensor 243, paper feed sensor 247, and registration sensor 256 exemplify a passage detection unit which is provided in the conveyance path, and detects passage of the medium.

<Internal Configuration of Slave CPU 602>

A CPU core 401 controls various kinds of devices using peripheral circuitry in accordance with a program. A flash memory 402 holds data and a program executed by the CPU core 401. An SRAM 403 is a working memory for the CPU core 401. A watch dog timer 404 is used to monitor the operation status of the CPU core 401. An interruption controller 405 receives a change in internal state in, for example, serial communication or that in state of a signal from an external I/O, or accepts an interruption factor according to which the type of processing is switched, thereby interrupting the processing of the CPU core 401. A general-purpose timer 406 is used to perform interruption at a period of 1 ms. A serial communication I/F 407 is a communication interface with which the slave CPU 602 performs serial communication with the sub-master CPU 601. A GPIO (General Purpose I/O) 412 includes a plurality of general-purpose input/output ports. The CPU core 401 acquires a detection signal from a sensor via the GPIO 412. The motors 606, 609, 610, and 611 are, for example, stepping motors. Each of the sheet absence detection sensor 243, paper feed sensor 247, and registration sensor 256 is, for example, a photo-interrupter sensor which includes, for example, an LED (Light-Emitting Diode) and phototransistor and generates a detection signal which changes in accordance with the characteristics of incident light on the phototransistor. Motor drivers 429, 430, and 431 update the excitation patterns of the motors in accordance with, for example, a plurality of phase excitation pattern signal inputs. PWM generators 410, 411, and 415 generate PWM (Pulse-Width Modulation) signals using the general-purpose timer 406.

<Stepping Motor Control>

The slave CPU 602 updates a driving signal sent to the motor driver 429, in accordance with the operation period of the PWM generator 410. A method of driving the stepping motor by the slave CPU 602 and PWM generator 410 may use a known unit, and a description thereof will not be given.

<Paper Sheet Conveyance Timing>

Figure 5A:
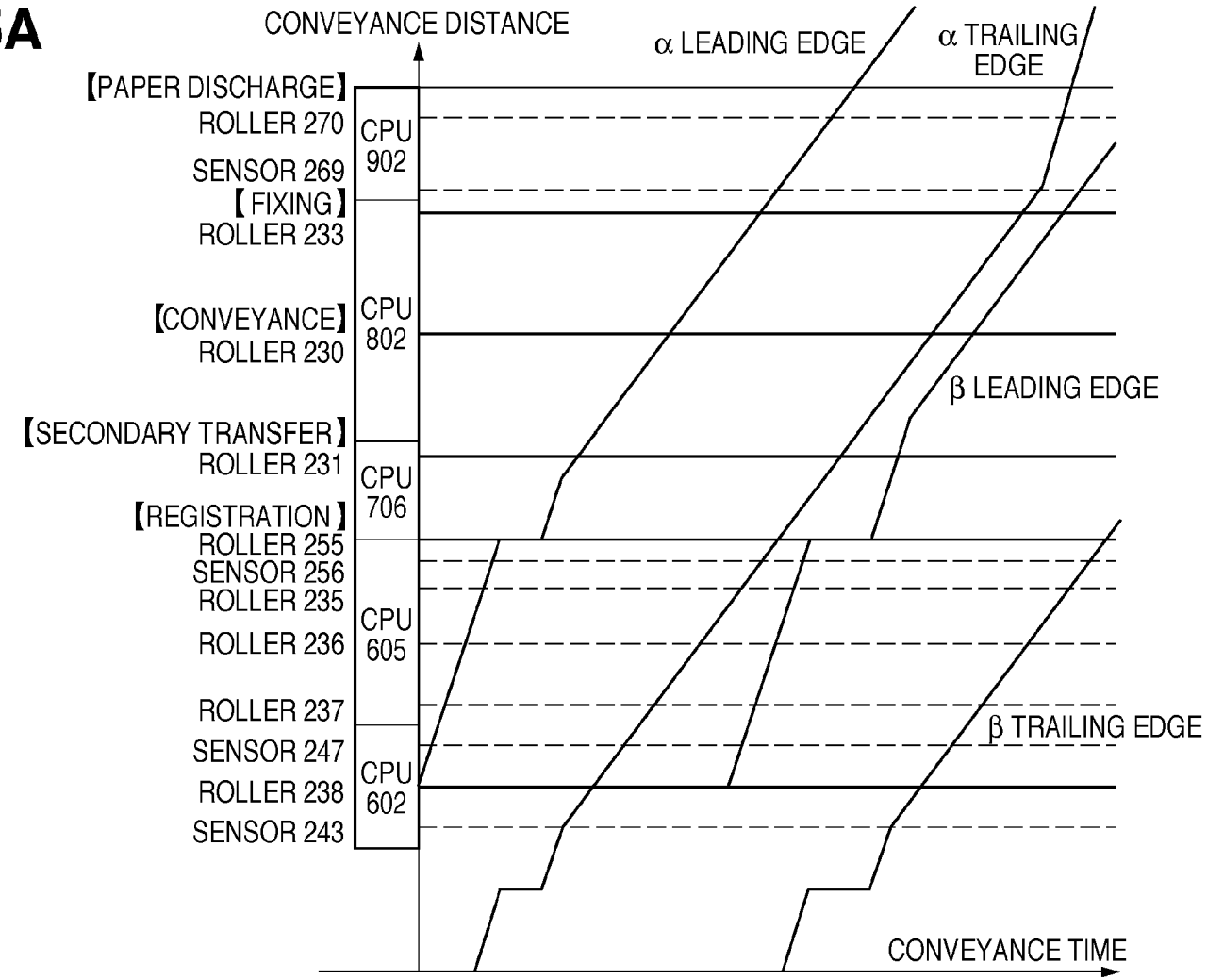
FIG. 5A is a chart illustrating an example of the paper sheet conveyance timing.

FIG. 5A illustrates an example of the paper sheet conveyance timing of the image forming apparatus. Conveyance of a total of two paper sheets α and β will be taken as an example herein. The leading edge position (a leading edge) and trailing edge position (a trailing edge) of paper sheet α, and the leading edge position (β leading edge) and trailing edge position (β trailing edge) of paper sheet β, are expressed as functions of time. When a paper feeding start instruction is sent from the master CPU 1001 to the sub-master CPU 601 in step S306*a*, the pickup roller 238 feeds and conveys paper sheet α. The paper feeding/conveyance velocity is, for example, 1,000 mm/s. When the leading edge position of paper sheet α reaches the registration roller pair 255, the rotation of which is stopped, the paper feeding roller pair 235, for example, continues the conveyance so as to form a loop with a length of about 5 mm on paper sheet α. In synchronization with the timing at which an image to be transferred onto paper sheet α, is formed, the registration roller pair 255 and the paper feeding roller pair 235 located upstream of it in the conveyance direction, for example, restart the conveyance. This operation will be referred to as "a registration ON operation" hereinafter. The registration ON operation velocity is, for example, 1,000 mm/s. The conveyance velocity of paper sheet α decelerates to 500 mm/s at a position of about 10 mm before the nip portion of the secondary transferring roller 231, and thereupon the toner image is transferred onto paper sheet α. The fixing unit 234 fixes the toner image while the conveyance velocity is kept at 500 mm/s. After the trailing edge of paper sheet α moves forward by 5 mm upon passing through fixing rollers 233, the paper discharge rollers 270 accelerate it to 1,000 mm/s again and discharge it. The registration roller pair 255 adjusts paper sheet β so as to be spaced apart from the trailing edge of preceding paper sheet α by a distance long enough to avoid their collision. In this state, the pickup roller 238 feeds and conveys paper sheet β. Although the conveyance timing afterward is the same as paper sheet α, the productivity of the image forming apparatus is adjusted in accordance with the registration ON operation timing.

FIG. 5B shows a data holding structure associated with conveyance passes. These data are stored in the flash memory 402 of each sub-master CPU. The name of a sub-master CPU which takes charge of a slave CPU described in a "Slave" column adjacent to a "Sub-master" column is described in the "Sub-master" column. The identification information of a corresponding slave CPU is described in an "ID" column. The sub-master CPUs 601, 701, 801, and 901 which engage with paper sheet conveyance assign IDs to the slave CPUs that are under their charge. The length of the conveyance pass that is under the charge of a corresponding slave CPU is described in a "Pass Length" column. A sensor connected to a corresponding slave CPU is described in a "Reference Sensor" column. The distance from the entrance of the conveyance pass to the sensor is described in a "Sensor Distance" column. The identification information assigned to a motor described in a "Motor" column is described in a "Motor ID" column. Not only the name of a motor but also that of a roller driven by this motor is described in the "Motor" column. The distance from the entrance of the conveyance pass to the roller is described in a "Roller Distance" column. The pieces of information of the entrance and exit positions with respect to a pickup roller are described in "Entrance Position" and "Exit Position" columns, respectively.

FIG. 5A also shows the conveyance pass that is under the charge of each slave CPU. For example, the slave CPU 602 takes charge of the conveyance pass from the sheet absence detection sensor 243 to the paper feed sensor 247 in the conveyance path. Hence, the slave CPU 602 exemplifies a first lower layer control unit which controls a conveyance unit that conveys the medium in the first conveyance section. The slave CPU 605 takes charge of the conveyance pass from the roller 237 to the registration roller pair 255. The slave CPU 605 exemplifies a second lower layer control unit which controls a conveyance unit that conveys the medium in the second conveyance section located downstream of the first conveyance section in the direction in which the medium is conveyed. Each sub-master CPU specifies the front-to-back relationship between the conveyance passes that are under the charge of the respective slave CPUs from the data holding structure shown in FIG. 5B. The sub-master CPU 601 exemplifies an upper layer control unit which controls the first lower layer control unit and second lower layer control unit.

<Timing Chart>

Figure 6A:
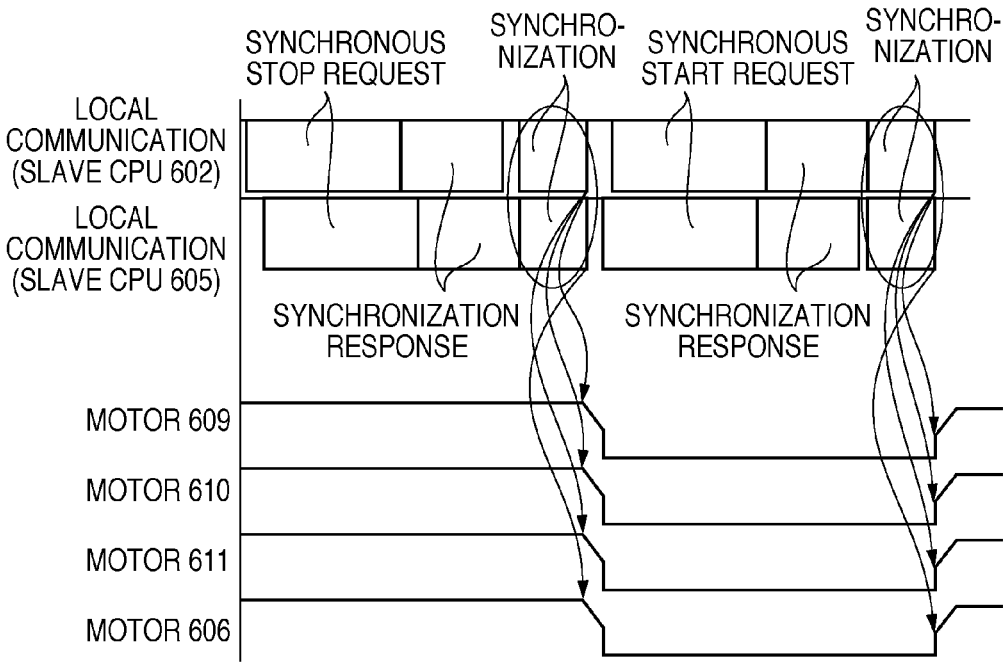
FIGS. 6A and 6B show timing charts of position correction and a registration ON operation.
Figure 6B:
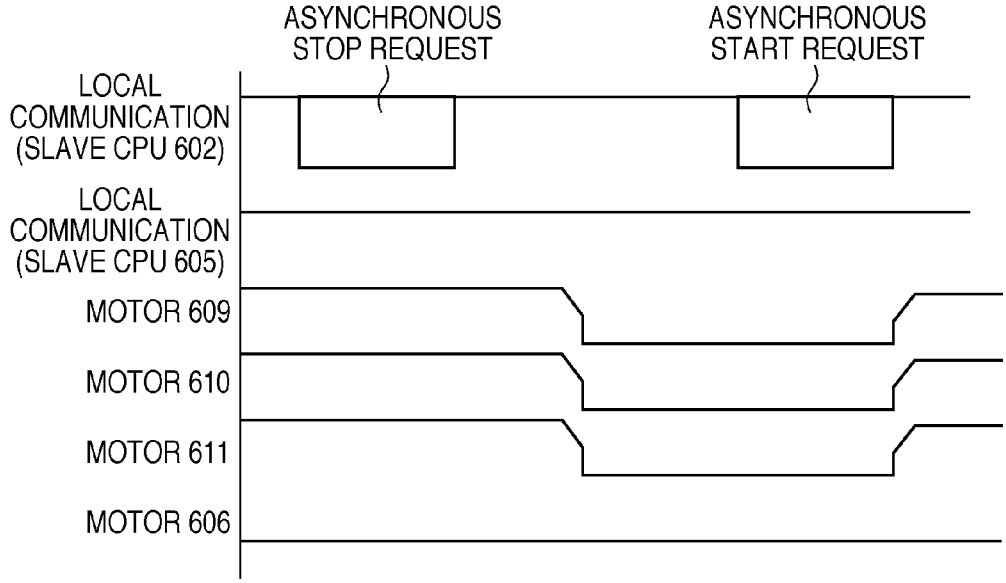

FIGS. 6A and 6B show timing charts of position correction (registration stop) and a registration ON operation. FIG. 6A illustrates especially an example in which registration stop and a registration ON operation are performed by synchronous driving of a large-sized paper sheet. That is, the sub-master CPU 601 recognizes the position of the medium in accordance with the detection results obtained by a plurality of passage detection units to determine whether the medium is at a position where both the first lower layer control unit and the second lower layer control unit engage with its conveyance control. The sub-master CPU 601 functions as a synchronous operation instruction unit which instructs the first lower layer control unit and second lower layer control unit to operate in synchronization with each other when it determines that the medium is at a position where both the first lower layer control unit and the second lower layer control unit engage with its conveyance control. The large-sized paper sheet is so long as to extend across a plurality of conveyance sections, as described above. Hence, there is a need to synchronize a plurality of slave CPUs which control these conveyance rollers with each other. A control command is sent/received via local communication lines 450 which serve as serial communication lines and are provided between the sub-master CPU 601 and the slave CPUs 602 and 605, respectively. When the sub-master CPU 601 sends a synchronous stop request, the slave CPUs 602 and 605 send back synchronization responses to the synchronize request command. The synchronous stop request exemplifies a synchronize request command indicating that the first lower layer control unit and second lower layer control unit stop the conveyance units, respectively controlled by them, in synchronization with each other. After that, the sub-master CPU 601 sends a synchronous operation command to the slave CPUs 602 and 605. The synchronous operation command indicates the synchronization timing. Upon receiving the synchronous operation command, the slave CPUs 602 and 605 stop the motors 606, and 609, 610, and 611, respectively, based on a request included in the synchronous stop command. The sub-master CPU 601 sends a synchronous start request via the local communication lines 450 to the slave CPUs 602 and 605. The synchronous start request exemplifies a synchronize request command indicating that the first lower layer control unit and second lower layer control unit start the conveyance units, respectively controlled by them, in synchronization with each other. The slave CPUs 602 and 605 send synchronization responses to the sub-master CPU 601 via the local communication lines 450. The sub-master CPU 601 sends a synchronous operation command to the slave CPUs 602 and 605. Upon receiving the synchronous operation command, the slave CPUs 602 and 605 start the motors 606, and 609, 610, and 611, respectively, based on a request included in the synchronous start request. The synchronous operation command may have a higher priority level and a shorter command length than other commands so as to perform synchronization without delay. A command can be simultaneously sent to a plurality of slave CPUs as long as multicast bus communication is available.

FIG. 6B illustrates an example in which a registration stop and a registration ON operation are performed by asynchronous driving of a small-sized paper sheet. The small-sized paper sheet is less likely to extend across a plurality of conveyance rollers, as described above. Hence, there is no need to synchronize a plurality of slave CPUs which control these conveyance rollers with each other. In other words, the number of commands can be decreased using asynchronous driving. Nevertheless, a plurality of slave CPUs sometimes simultaneously engage with conveyance of even a small-sized paper sheet. In this case, the same processing as that in the case of a large-sized paper sheet is performed. An example in which the paper sheet enters the conveyance pass that is under the charge of the slave CPU 605 will be described herein. The sub-master CPU 601 sends an asynchronous stop request to the slave CPU 605 via the local communication line 450. The asynchronous stop request and an asynchronous start request exemplify asynchronous operation commands indicating that the first lower layer control unit and second lower layer control unit operate the conveyance units, respectively controlled by them, asynchronously to each other. The sub-master CPU 601 functions as an asynchronous operation instruction unit which instructs the second lower layer control unit to operate asynchronously to the first lower layer control unit when it determines that the medium is not at a position where both the first lower layer control unit and the second lower layer control unit engage with its conveyance control. The slave CPU 605 stops the motors 609, 610, and 611 based on the reception of an asynchronous stop request. The sub-master CPU 601 sends an asynchronous start request to the slave CPU 605 via the local communication line 450. The slave CPU 605 starts the motors 609, 610, and 611 based on the reception of an asynchronous start request.

In this manner, the sub-master CPU 601 determines based on the size of the paper sheet whether synchronous driving is necessary or asynchronous driving suffices. In other words, the sub-master CPU 601 functions as a determination unit which determines whether the medium is at a position where both the first lower layer control unit and the second lower layer control unit engage with its conveyance control. Thus, the sub-master CPU 601 decides, in accordance with the position of the medium in the conveyance path, whether paper sheet conveyance by a single slave CPU or by a plurality of slave CPUs is to be performed. In accordance with this determination result, the sub-master CPU 601 instructs a slave CPU which engages with paper sheet conveyance to perform synchronous driving or asynchronous driving. In this embodiment, especially because asynchronous driving is adopted only for some types of media, the communication traffic can be reduced as compared with a case in which synchronous driving is adopted for all types of media. The productivity is generally lower in large-sized paper than in small-size paper, so the communication traffic per unit time, in turn, is smaller in the former than in the latter. Also, positions on the conveyance path, which require synchronous driving, are fewer in small-sized paper than in large-sized paper. Hence, the frequency of synchronous driving is relatively low, so a great effect of reducing the communication traffic is produced by the foregoing processing.

<Control Sequence of Sub-Master CPU>

Figure 7A:
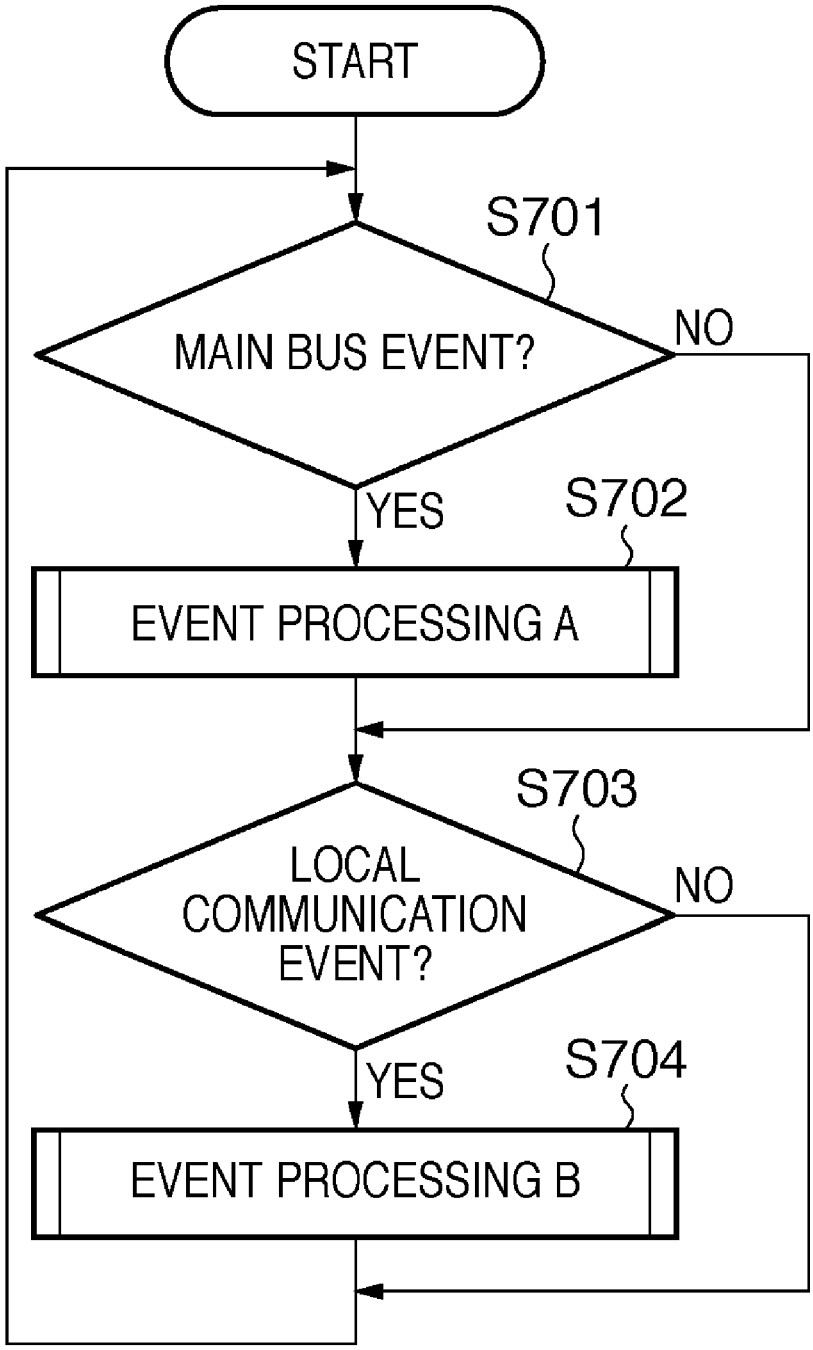
FIGS. 7A to 7D are flowcharts of sub-master CPUs.

FIG. 7A shows main loop processing of the sub-master CPUs 601, 801, and 901. In step S701, the sub-master CPU determines whether a command has arrived at the main bus 1002. If NO is determined in step S701, the process directly advances to step S703; otherwise, the process advances to step S702. In step S702, the sub-master CPU executes event processing A shown in FIG. 7B. In step S703, the sub-master CPU determines whether a command has arrived via the local communication line 450. If NO is determined in step S703, the process returns to step S701; otherwise, the process advances to step S704. In step S704, the sub-master CPU executes event processing B.

<Main Bus Event Processing>

Figure 7B:
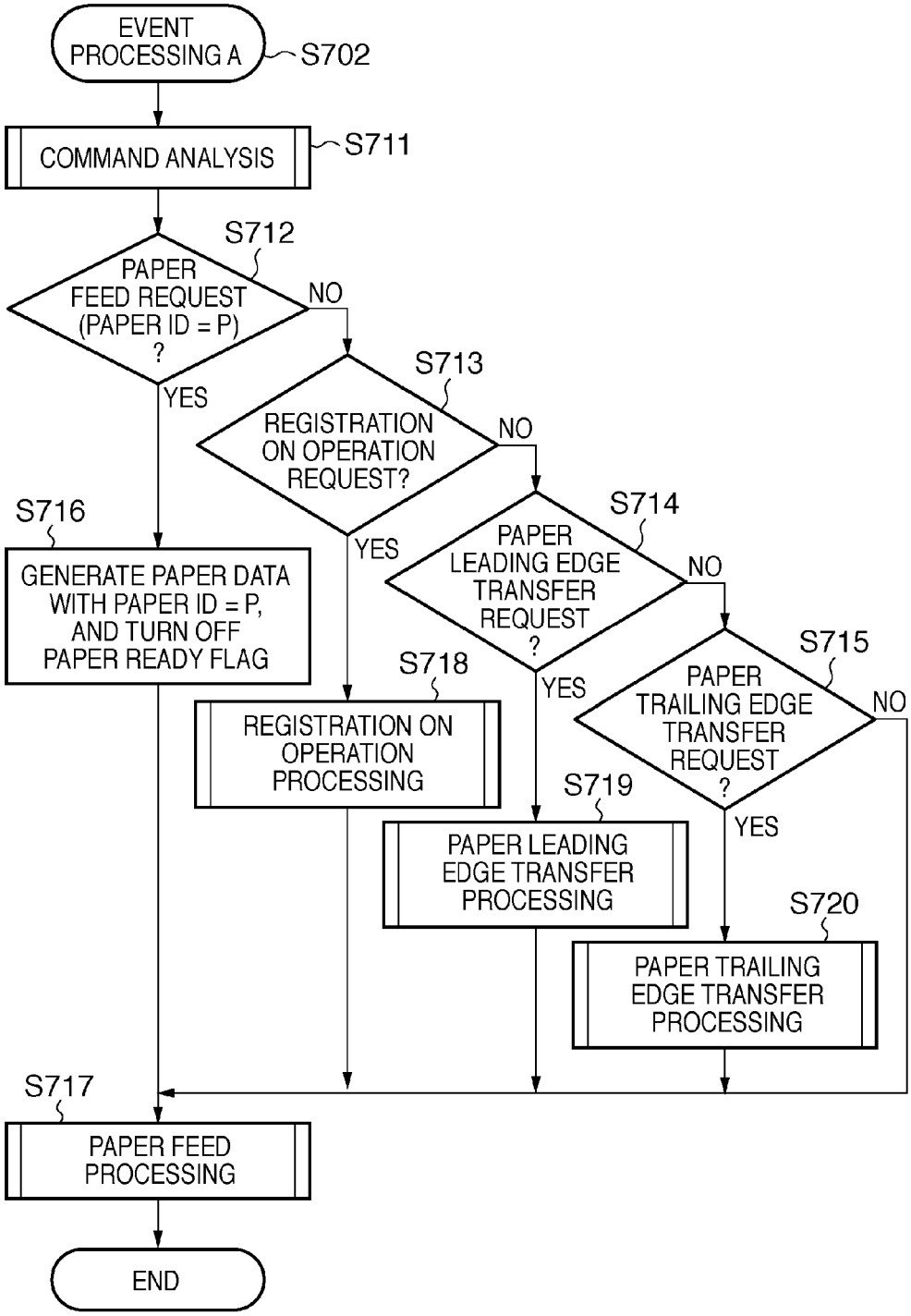

Event processing A (main bus event processing) in step S702 will be described with reference to FIG. 7B. In step S711, the sub-master CPU analyzes the command received via the main bus 1002, in accordance with a command format defined by both it and the master CPU 1001 in advance. In step S712, the sub-master CPU determines whether the details of the command pertain to a paper feed request. If NO is determined in step S712, the sub-master CPU determines in step S713 whether the details of the command pertain to a registration ON operation request. If NO is determined in step S713, the sub-master CPU determines in step S714 whether the details of the command pertain to a paper leading edge transfer request. If NO is determined in step S714, the sub-master CPU determines in step S715 whether the details of the command pertain to a paper trailing edge transfer request.

If the details of the command pertain to a paper feed request, in step S716 the sub-master CPU stores, in the SRAM 403, paper data corresponding to the paper ID (P in this case) designated by the command. FIG. 8A illustrates an example of the paper data. Paper data is generated for each paper ID. The paper data includes, for example, information (leading edge-in-charge slave ID (N1)) indicating a slave CPU which takes charge of the leading edge of the paper, that (trailing edge-in-charge slave ID (N2)) indicating a slave CPU which takes charge of the trailing edge of the paper, and that indicating the size of the paper (its length and width in the conveyance direction), its grammage, its surface characteristics, and a leading-edge motor. The sub-master CPU updates the paper data in accordance with its control state. That is, the slave CPU notifies the sub-master CPU of the paper ID and a message indicating to that effect at the timing at which the leading or trailing edge of the paper sheet that is under its charge becomes free from its charge. When the paper sheet is under the charge of a slave CPU, this slave CPU can engage with its conveyance via, for example, the conveyance roller. The message indicating to that effect is information indicating that the leading or trailing edge of the paper sheet that has previously been under the charge of a slave CPU becomes free from the charge of the slave CPU. The sub-master CPU receives this notification and updates the paper data based on it. The sub-master CPU notifies a slave CPU, which takes charge of an adjacent section located downstream of the section that is under the charge of the slave CPU which has sent the notification, of its slave ID, the paper ID, and the message indicating to that effect. Note that the slave CPU can be used to detect the timing at which the leading or trailing edge of the paper sheet passes through the sensor that is under its charge. The slave CPU holds, in advance in, for example, a ROM as data, the conveyance velocity of the paper sheet and the distance from the position in the conveyance path, where a sensor which detects the leading or trailing edge of the paper sheet is provided, to the most downstream position that falls within its in-charge range. Hence, the slave CPU can calculate the conveyance time of the paper sheet by dividing that distance by that conveyance velocity. In other words, the slave CPU can estimate the timing, at which the leading edge of the paper sheet passes through the most downstream position, by adding the timing (time of day) at which the sensor senses this leading edge. The timing at which the trailing edge of the paper sheet passes through the most downstream position can also be estimated by the same method as in the leading edge because the same relationship as in the leading edge holds true for the trailing edge. The most downstream position is the boundary between the in-charge range and out-of-charge range of the slave CPU. Hence, the slave CPU can detect the timing at which the leading or trailing edge of the paper sheet becomes free from its charge. Note that the in-charge range of each slave CPU means each conveyance section. Although FIG. 8A does not describe the actual load name for the sake of descriptive convenience, the slave ID or motor ID shown in FIG. 5B, for example, may be stored. In step S716, the sub-master CPU turns off a paper ready flag (to be described later). In step S717, the sub-master CPU starts paper feed processing.

If YES is determined in step S713, in step S718 the sub-master CPU performs registration ON operation processing for starting the motor which drives the registration roller pair 255. The registration ON operation processing will be described in detail later. If YES is determined in step S714, the sub-master CPU performs paper leading edge transfer processing in step S719. In the paper leading edge transfer processing, for example, the conveyance load of the slave CPU 605 is started upon recognizing that the paper leading edge leaves the conveyance pass which is under the charge of the slave CPU 602 shown in FIG. 5B and comes into that which is under the charge of the slave CPU 605. If YES is determined in step S715, the sub-master CPU performs paper trailing edge transfer processing in step S720. In the paper trailing edge transfer processing, for example, the conveyance load of the slave CPU 602 is stopped upon recognizing that the paper trailing edge leaves the conveyance pass which is under the charge of the slave CPU 602 shown in FIG. 5B and comes into that which is under the charge of the slave CPU 605. As described above, the sub-master CPU 601 functions as a recognition unit which recognizes the position of the medium, and therefore recognizes the leading and trailing edge positions of the paper in accordance with the paper data shown in FIG. 8A as needed. Hence, the sub-master CPU 601 issues a paper leading edge transfer request and paper trailing edge transfer request as internal events in paper leading edge conveyance position processing (to be described later).

Figure 8B:
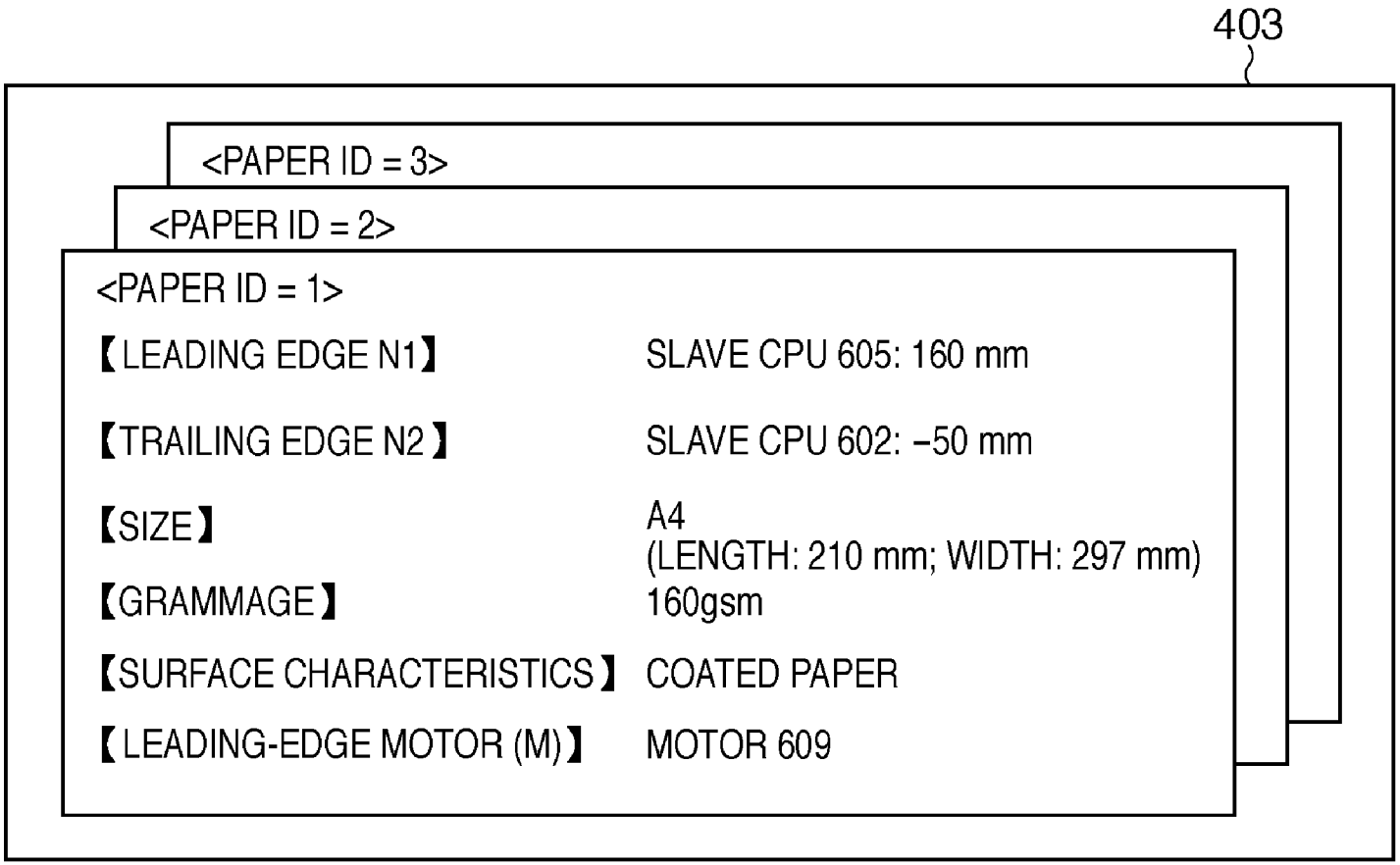
FIG. 8B is a view illustrating an example of paper data.

FIG. 8A illustrates an example of the command format determined by both the sub-master CPU and the slave CPU in advance. The commands in the command format are sent/received by serial communication via the local communication lines 450. The name of each command is described in a "Command Table" column. The direction to transmit each command (whether each command is transmitted from a master to a slave or from the slave to the master) is described in a "Direction" column. Whether synchronization between slave CPUs is necessary is described in a "Synchronization" column. Also, various types of parameters can be included in each command. FIG. 8B illustrates an example of the various types of parameters. Identification information for identifying each command is described in the command ID (CMD-ID). For example, motor start A is a command transmitted from a sub-master CPU (M) to a slave CPU (S), and has an ID "0100h". In this example, each command can have a maximum of four parameters. The motor ID indicating a motor to be driven, the motor driving velocity (unit: pps), the motor driving acceleration (unit: $pps^2$), and the current value (unit: %), for example, are prepared as parameters.

<Local Communication Event Processing>

Figure 7C:
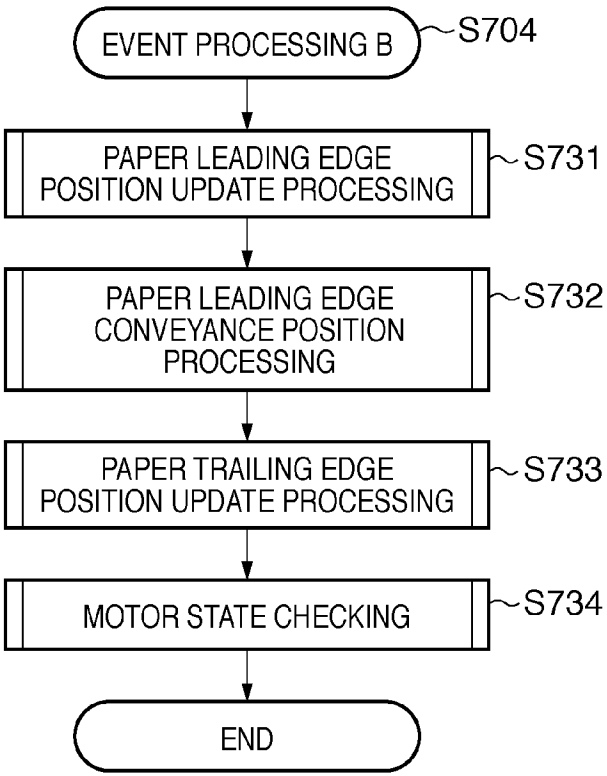

Event B (local communication event processing) in step S704 will be described with reference to FIG. 7C. The sub-master CPU advances conveyance processing upon receiving a timing event from the slave CPU. The sub-master CPU analyzes the details of the command received via the local communication line 450, in accordance with the command format shown in FIG. 8A. The sub-master CPU executes paper leading edge position update processing in step S731, paper leading edge conveyance position processing in step S732, and paper trailing edge position update processing in step S733, and checks the motor state in step S734. In the paper leading edge position update processing and paper trailing edge position update processing, the leading and trailing edge positions are updated using sensor detect commands (0900h and 0910h shown in FIG. 8B) and signal and motor driving pulse count commands (0A00h and 0B00h).

<Position Correction (Registration Stop) Processing>

The paper leading edge conveyance position processing in step S732 is associated with all types of events in the conveyance pass, and differs for each sub-master CPU. Paper leading edge conveyance position processing in the sub-master CPU 601 will be described as an example with reference to FIG. 7D. Note that the leading edge position of the paper sheet is recognized upon the paper leading edge position update processing in step S731, which has been described earlier. In step S741, the sub-master CPU determines whether the leading edge of the paper sheet has reached a position (the position of the registration sensor 256) of 240 mm from the pickup roller 238. If NO is determined in step S741, the process advances to step S743; otherwise, the process advances to step S742. In step S742, the sub-master CPU issues a registration stop request for position correction. In step S743, the sub-master CPU determines whether the leading edge of the paper sheet has reached a position (that is, the registration stop position) of 260 mm from the pickup roller 238. If YES is determined in step S743, the sub-master CPU turns on a paper ready flag in step S744. The paper ready flag means herein a flag indicating that the paper sheet has reached the registration stop position for position correction, that is, information indicating that a registration ON operation in synchronization with a toner image is enabled. In step S741, the sub-master CPU performs synchronization processing (to be described later).

<Registration Stop Request Processing>

Figure 7D:
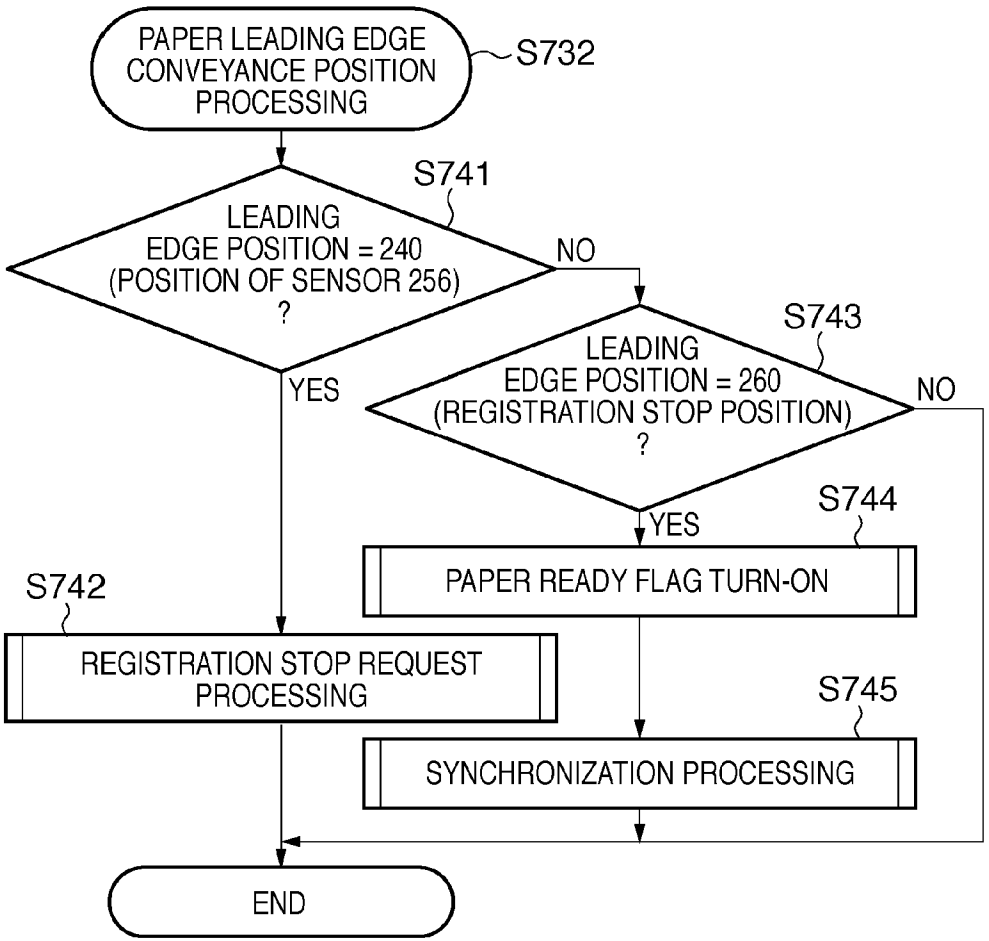
Figure 9A:
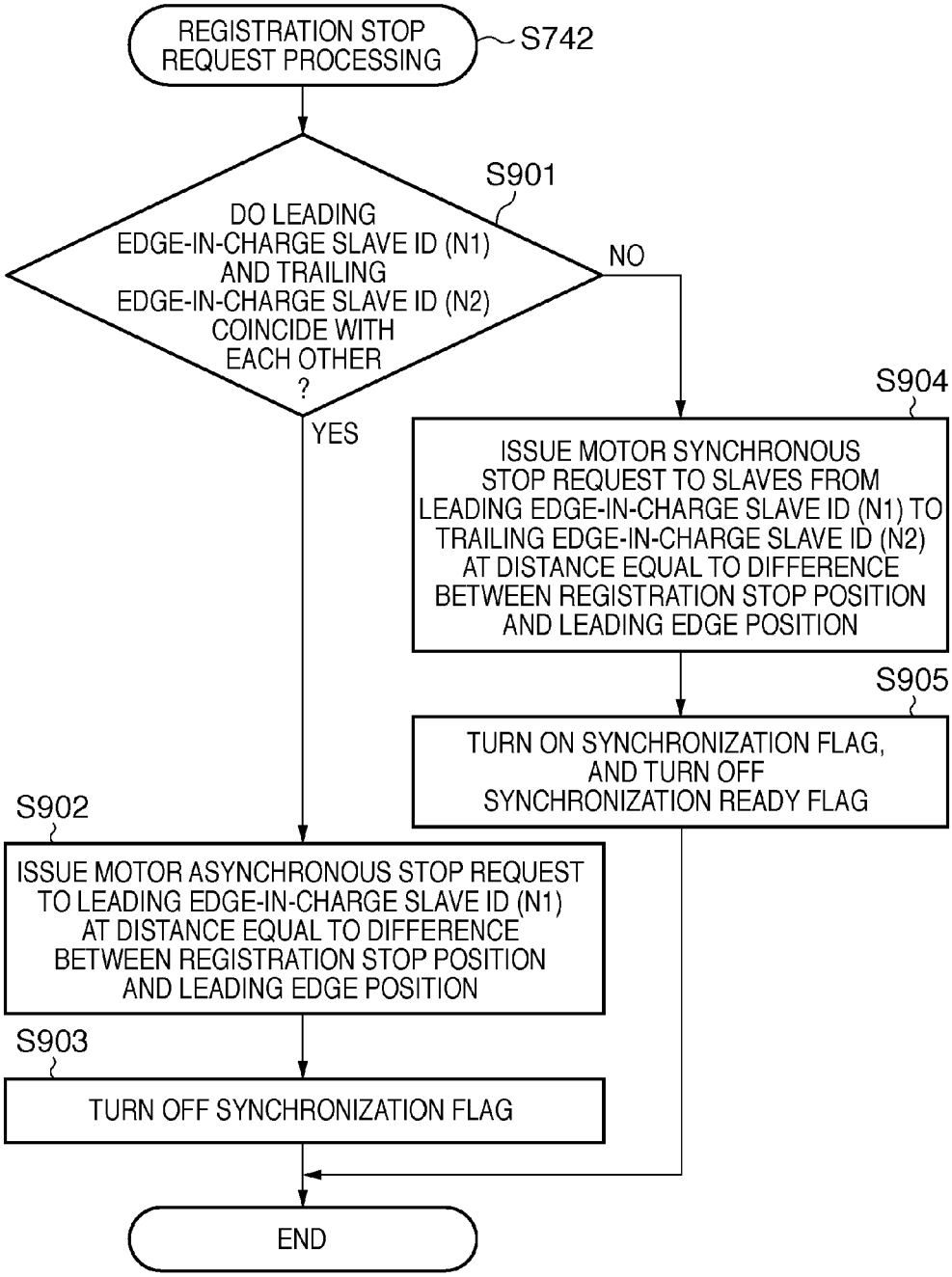
FIGS. 9A to 9C are flowcharts of the sub-master CPUs.

FIG. 9A is a flowchart showing details of the registration stop request processing in step S742 of FIG. 7D. In step S901, the sub-master CPU refers to the paper data to determine whether the leading edge-in-charge slave ID (N1) and trailing edge-in-charge slave ID (N2) of the paper sheet to undergo registration stop coinciding with each other. If N1=N2, the paper sheet is being conveyed by a single slave CPU, and therefore need not undergo synchronous registration stop. On the other hand, if N1≠N2, the paper sheet is being simultaneously conveyed by a plurality of slave CPUs, and therefore needs to undergo synchronous registration stop. In this manner, step S901 corresponds to processing for determining whether synchronous processing is necessary or asynchronous processing suffices. The paper data serving as a criterion for this determination reflects pieces of information on the size of the paper sheet and the position of the paper sheet in the conveyance path.

If YES is determined in step S901, the process advances to step S902. In step S902, the sub-master CPU sends a motor asynchronous stop request (motor stop B: 0210h) to the slave CPU, designated by the leading edge-in-charge slave ID (N1), at a timing corresponding to a distance equal to the difference between the registration stop position and the paper sheet leading edge position. In step S903, the sub-master CPU turns off a synchronization flag indicating a synchronous stop request.

If NO is determined in step S901, the process advances to step S904. In step S904, the sub-master CPU sends a motor synchronous stop request (motor stop A: 0200h) to all slave CPUs which are present between the leading edge-in-charge slave ID (N1) and the trailing edge-in-charge slave ID (N2). Although two slave CPUs are targeted in this example, a conveyance path in which three or more slave CPUs are targeted in the conveyance path may be present. The sub-master CPU assigns a slave ID to each slave CPU. Note that slave IDs are assigned to the slave CPUs in ascending order from the upstream side in the conveyance path to its downstream side (in accordance with the order in which the slave CPUs engage with conveyance). Hence, if N1=3 and N2=1, the second slave CPU between the first and third slave CPUs also undergoes synchronous driving. In step S905, the sub-master CPU turns on a synchronization flag indicating a synchronous stop request, and a synchronization ready flag is turned off. Thus, the standby status for synchronization is held in the memory.

<Motor State Check Processing>

Figure 9B:
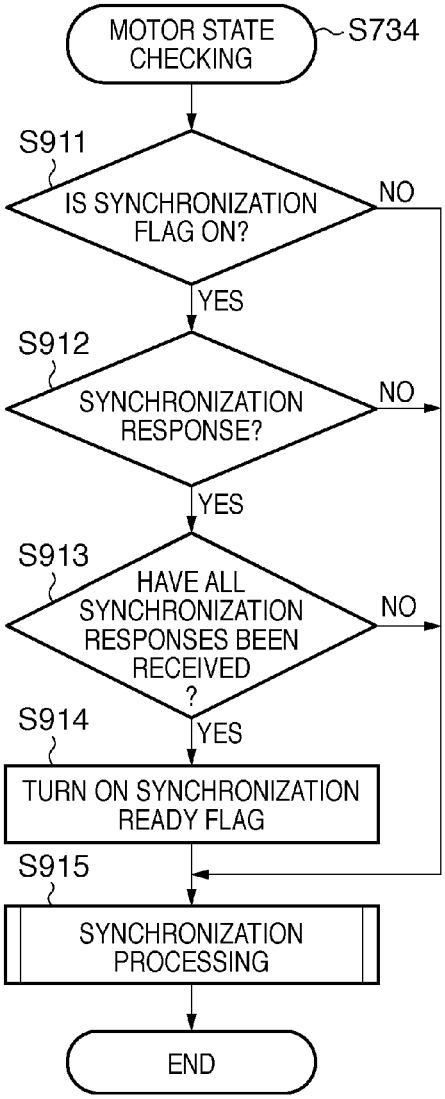

The motor state checking in step S734 of FIG. 7C will be described with reference to FIG. 9B. In step S911, the sub-master CPU determines whether a synchronization flag is ON. If NO is determined in step S911, the process directly advances to step S915; otherwise, the process advances to step S912. In step S912, the sub-master CPU determines whether the event received from the slave CPU is a synchronization response (0600h). If NO is determined in step S912, the process directly advances to step S915; otherwise, the process advances to step S913. In step S913, the sub-master CPU determines whether synchronization responses (0600h) have been able to be received from all slave CPUs to which a synchronous stop request has been sent in step S904. If NO is determined in step S913, the process directly advances to step S915; otherwise, the process advances to step S914. In step S914, the sub-master CPU turns on a synchronization ready flag indicating that the slave CPUs are ready for synchronization. In step S915, the sub-master CPU executes synchronization processing.

<Synchronization Processing>

Figure 9C:
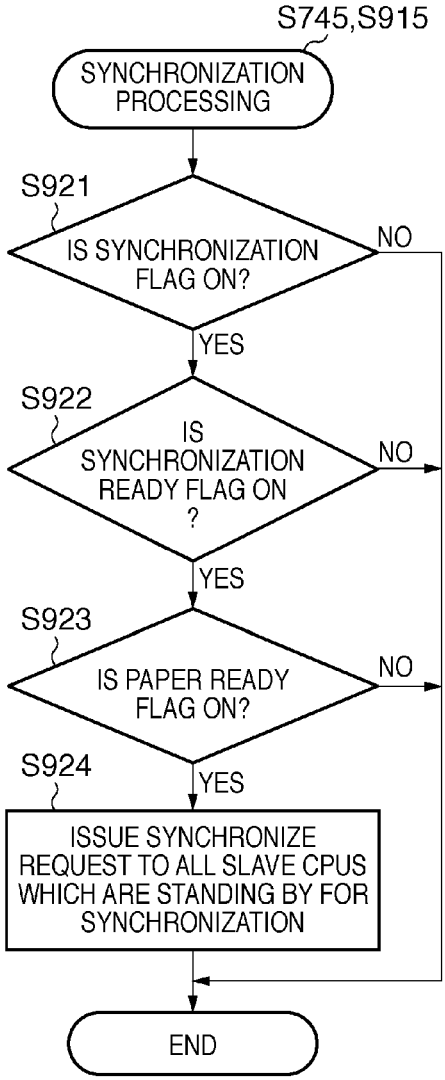

The synchronization processing in steps S745 and S915 will be described with reference to FIG. 9C. In step S921, the sub-master CPU determines whether a synchronization flag is ON. If YES is determined in step S921, the process advances to step S922. In step S922, the sub-master CPU determines whether a synchronization ready flag is ON. If YES is determined in step S922, the process advances to step S923. In step S923, the sub-master CPU determines whether a paper ready flag is ON. If YES is determined in step S923, the process advances to step S924. In step S924, the sub-master CPU sends a synchronize request (0500h) to all slave CPUs to which a synchronous stop request has been sent in step S742. In this manner, when both the conditions that each slave CPU is ready for synchronization and that the leading edge of the paper sheet has reached the registration stop position are satisfied, a synchronize request (0500h) is sent. The paper ready flag is information used to prevent a synchronize request from being sent before the paper sheet reaches the registration stop position.

<Registration ON Operation Processing>

Figure 10:
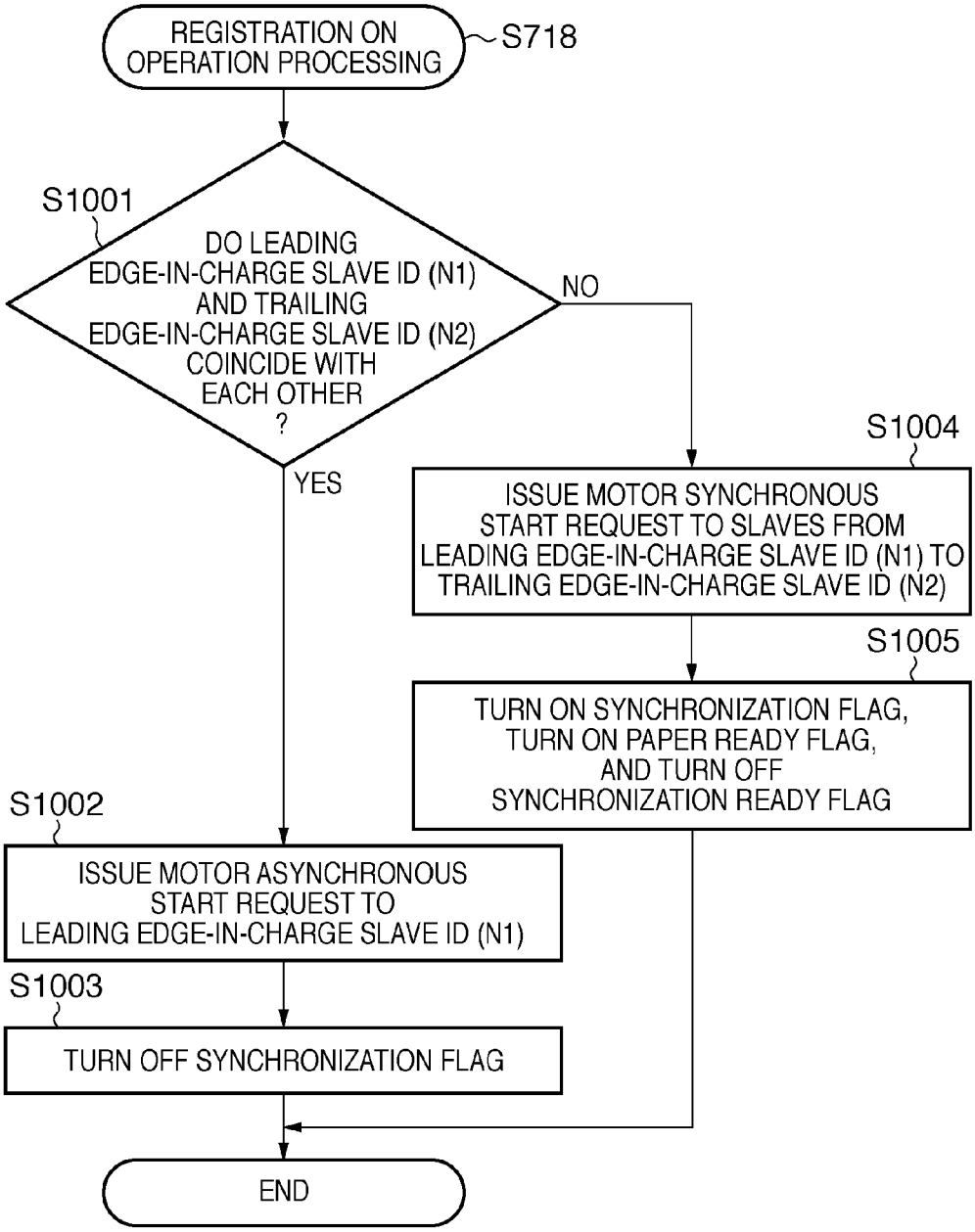
FIG. 10 is a flowchart of a sub-master CPU.

The registration ON operation processing in step S718 will be described in detail with reference to FIG. 10. In step S1001, the sub-master CPU refers to the paper data to determine whether the leading edge-in-charge slave ID (N1) and trailing edge-in-charge slave ID (N2) of the paper sheet to undergo a registration ON operation coincide with each other. If N1=N2, the fact that the paper sheet is being conveyed by a single slave CPU can be recognized. In this case, therefore, the sub-master CPU determines that the paper sheet need not undergo a synchronous registration ON operation. On the other hand, if N1≠N2, the fact that the paper sheet is being simultaneously conveyed by a plurality of slave CPUs can be recognized. In this case, therefore, the sub-master CPU determines that the paper sheet needs to undergo a synchronous registration ON operation.

If YES is determined in step S1001, the process advances to step S1002. In step S1002, the sub-master CPU sends a motor asynchronous start request (motor start B: 0110h) to the slave CPU designated by the leading edge-in-charge slave ID (N1). In step S1003, the sub-master CPU sets a synchronization flag indicating a synchronous start request to OFF. On the other hand, if NO is determined in step S1001, the process advances to step S1004. In step S1004, the sub-master CPU sends a motor synchronous start request (motor start A: 0100h) to all slave CPUs corresponding to slave IDs which are present between N1 and N2. In step S1005, the sub-master CPU turns on a synchronization flag indicating a synchronous start request, and turns off a synchronization ready flag. Thus, the standby status for synchronization is held in the memory. Note that the paper sheet is stopped and on standby upon a registration ON operation. Hence, the sub-master CPU turns on the paper ready flag. After that, synchronization processing is performed by the motor state checking in step S734 of FIG. 9B, so a plurality of motors are started in synchronization with each other.

A plurality of slave CPUs perform synchronous/asynchronous motor control in position correction (registration stop) and a registration ON operation, as described above.

Synchronous/asynchronous motor driving can be performed with almost the same sequence in, for example, deceleration before secondary transfer, and acceleration after fixing.

<Event Sequence 1 Between Sub-Master CPU and Slave CPUs>

Figure 11A:
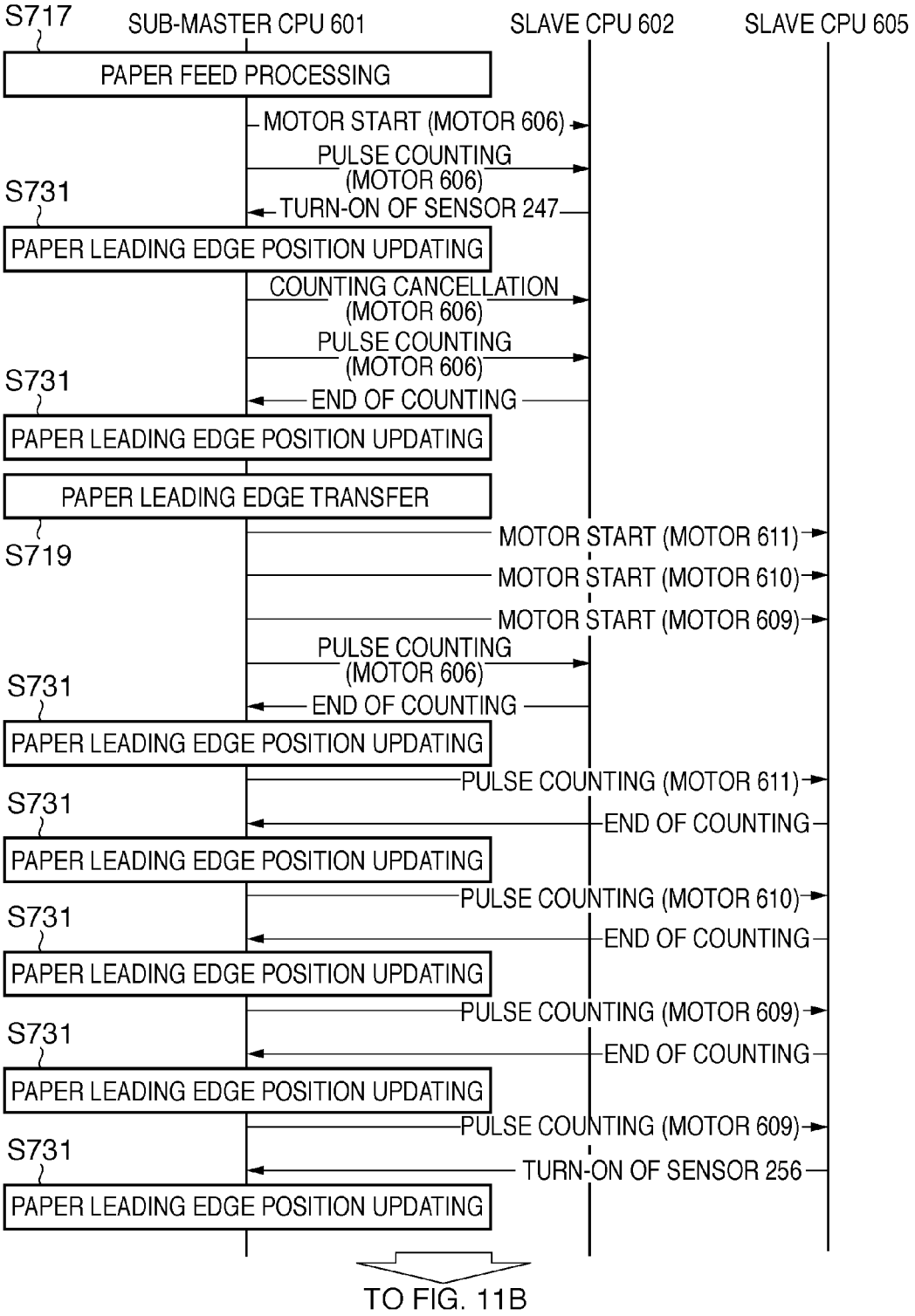
FIGS. 11A and 11B are sequence charts showing a communication event sequence.
Figure 11B:
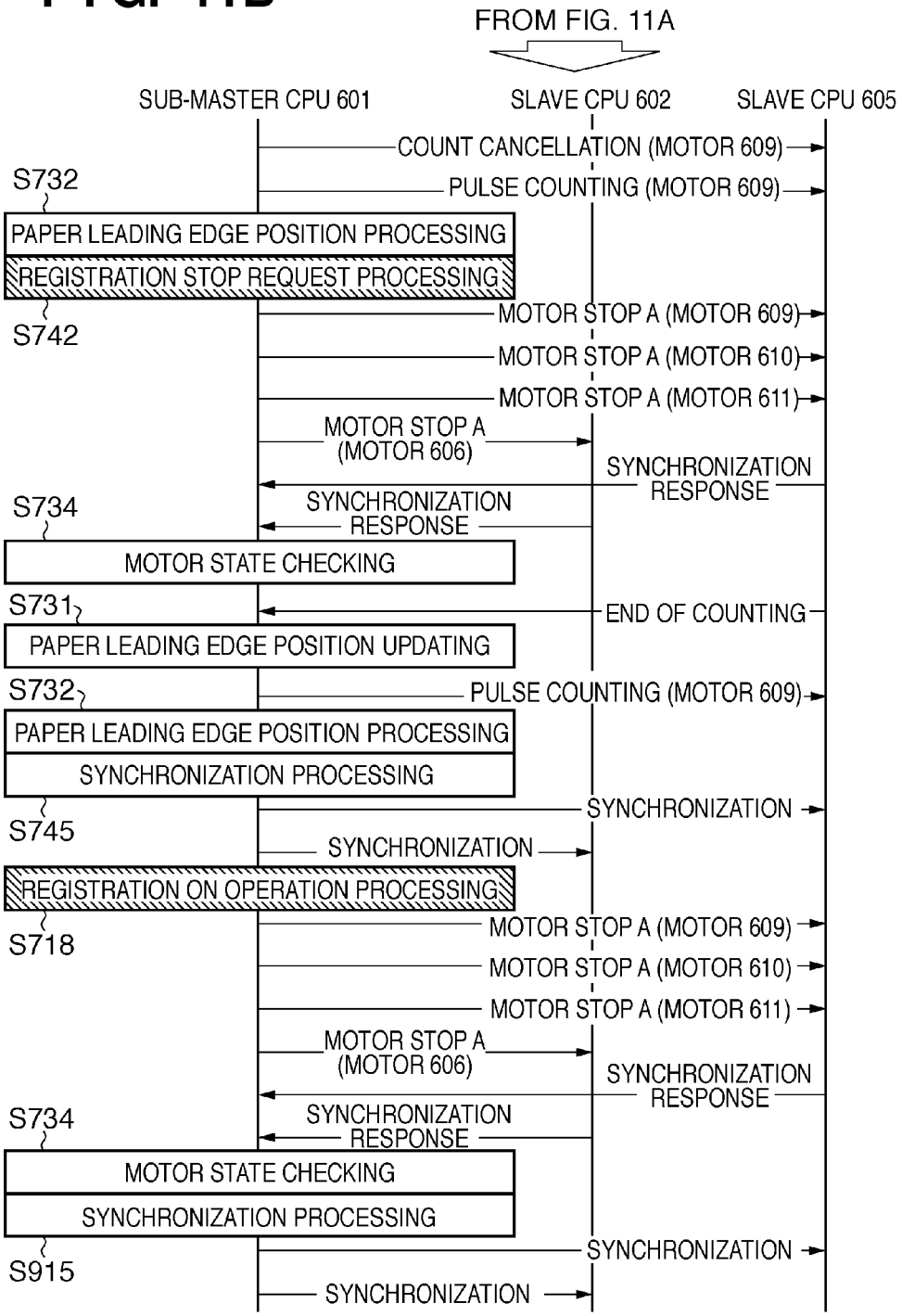

FIGS. 11A and 11B illustrate a communication event sequence between the sub-master CPU 601 and the slave CPUs 602 and 605 in a series of operations for large-sized paper: the start of paper feeding, position correction (registration stop), and a registration ON operation. In other words, this event sequence is a synchronous sequence. Part corresponding to the processing in the above-mentioned flowchart in each event is described. Since large-sized paper is used as the paper sheet, registration stop and a registration ON operation are executed synchronously. The large-sized paper has, for example, a length in the conveyance direction, which is longer than 220 mm that is the length of the conveyance pass which is under the charge of the sub-master CPU 601. The large-sized paper is, for example, A3-size paper. In other words, 220 mm is used as a predetermined threshold in this embodiment. Note that a plurality of slave CPUs may simultaneously engage with conveyance in part of the conveyance path despite the use of small-sized paper.

When the master CPU 1001 issues a paper feed request to the sub-master CPU 601 (S717), the sub-master CPU 601 starts the motor 606 of the slave CPU 602 to drive the pickup roller 238. When the paper leading edge reaches the paper feed sensor 247, and a sensor turn-on command is sent from the slave CPU 602 to the sub-master CPU 601, the paper position is updated in paper leading edge position updating (S731). Pulse counting of the motor 606 is continuously performed to obtain a timing at which the leading edge of the paper sheet reaches the exit of the conveyance pass that is under the charge of the slave CPU 602. A pulse count completion event of the motor 606 is received in paper leading edge position updating (S731), and the leading edge of the paper sheet is transferred to the slave CPU 605 in paper leading edge transfer (S719). The leading edge of the paper sheet enters the conveyance pass that is under the charge of the slave CPU 605, so an asynchronous start request (motor start B: 110h) is sent to the motors 609, 610, and 611 of the slave CPU 605. Paper leading edge position update processing (S731) is sequentially executed at the timings at which the paper leading edge reaches the rollers 237, 236, and 235 which are driven by the motors 609, 610, and 611.

Referring to FIG. 11B, the registration sensor 256 detects passage of the paper leading edge before the paper feed sensor 247 senses passage of the trailing edge of the medium after it senses passage of the leading edge of the medium. The sub-master CPU 601 sends a motor synchronous stop request (motor stop A: 200h) to the slave CPUs 602 and 605 by paper leading edge conveyance position processing (S732) and registration stop request processing (S742). The sub-master CPU 601 functions as a synchronous operation instruction unit which instructs the first lower layer control unit and second lower layer control unit to operate in synchronization with each other when the second sensing unit senses passage of the leading edge of the medium before the first sensing unit senses passage of the trailing edge of the medium. In response to synchronization responses arrived from the slave CPUs 602 and 605, it is determined in motor state checking (S734) whether synchronous stop is to be performed. If the leading edge of the paper sheet has not yet reached the registration stop position at this moment, the process waits until a count completion event of the motor 609 arrives. When a count completion event of the motor 609 arrives at the sub-master CPU 601 from the slave CPU 605, paper leading edge conveyance position processing (S732) and synchronization processing (S745) are executed. When a registration ON operation request arrives from the master CPU 1001, registration ON operation processing (S718) is executed, and a motor synchronous start request (motor start A: 100h) is sent to the slave CPUs 602 and 605. As soon as synchronization responses (0600h) from both the slave CPUs 602 and 605 are received, a synchronize request (0500h) is sent to the slave CPUs 602 and 605 in motor state checking (S734), thereby performing a registration ON operation for the paper sheet.

<Event Sequence 2 Between Sub-Master CPU and Slave CPUs>

Figure 12A:
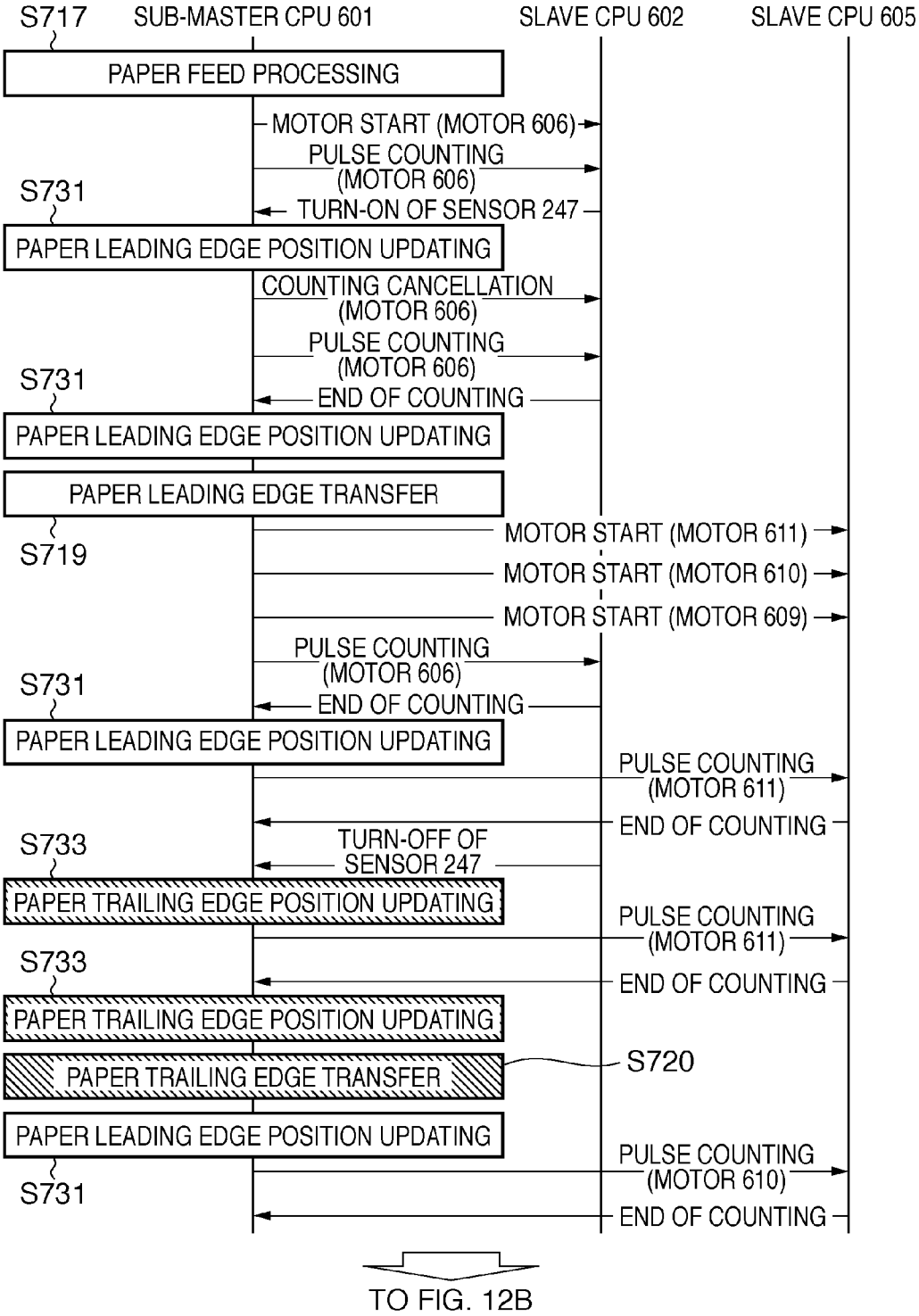
FIGS. 12A and 12B are sequence charts showing another communication event sequence.
Figure 12B:
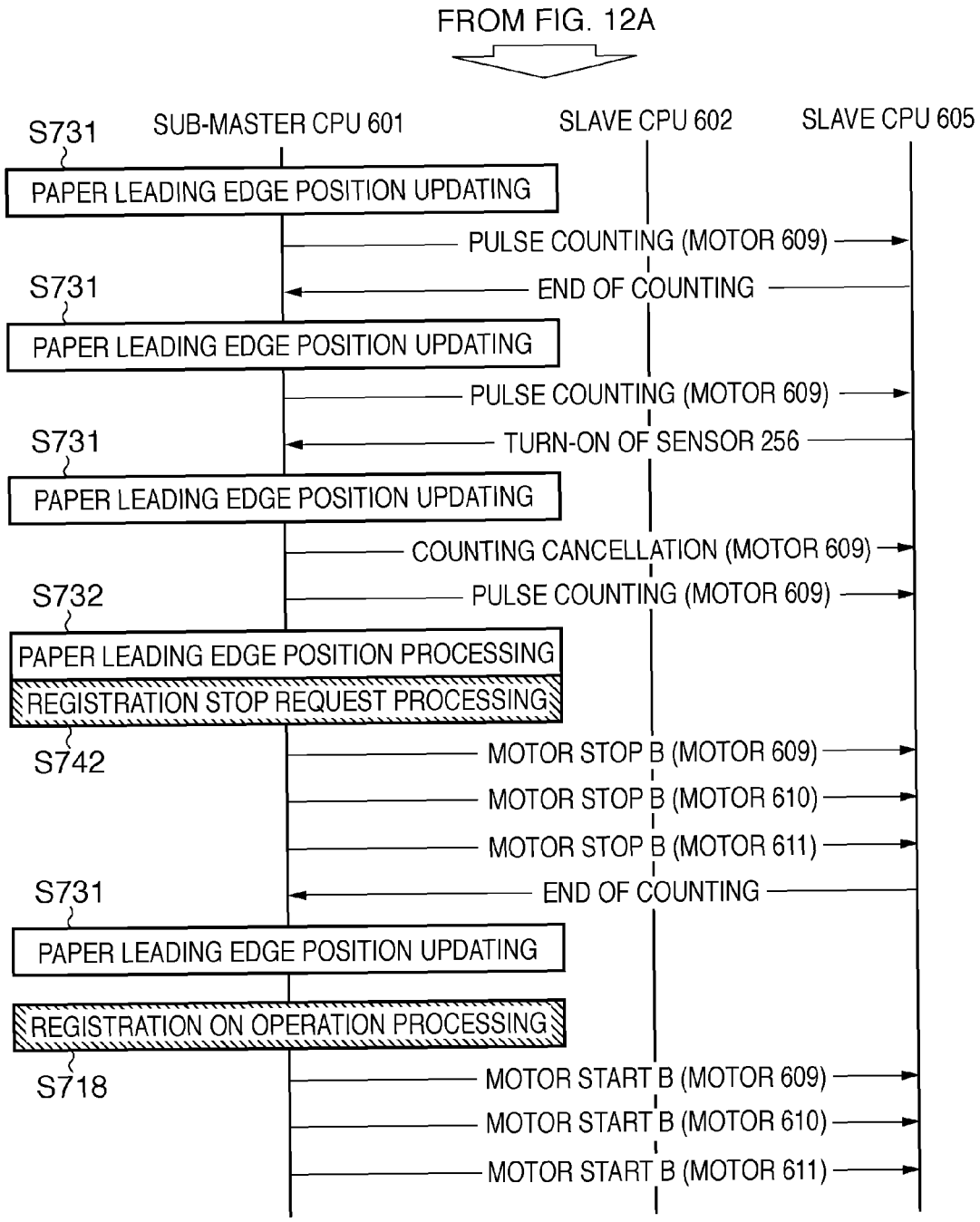

FIGS. 12A and 12B illustrate an example of a communication event sequence between the sub-master CPU 601 and the slave CPUs 602 and 605 in a series of operations for small-sized paper: the start of paper feeding, position correction (registration stop), and a registration ON operation. In other words, this event sequence is an asynchronous sequence. The sequence of the start of paper feeding is the same as that shown in FIGS. 11A and 11B. The small-sized paper has, for example, a length in the conveyance direction, which is shorter than 220 mm that is the length of the conveyance pass which is under the charge of the sub-master CPU 601. The small-sized paper is, for example, A4-size paper. Since small-sized paper is used, the paper trailing edge reaches the paper feed sensor 247 of the slave CPU 602 before a registration ON operation. In other words, the sub-master CPU 601 is notified of sensor OFF before a registration ON operation. Paper trailing edge position updating (S731) and paper trailing edge transfer (S720) are executed based on the motor pulse in the same way as in the paper leading edge. After the paper feed sensor 247 senses passage of the trailing edge of the medium, the registration sensor 256 senses passage of the paper leading edge. The sub-master CPU 601 sends an asynchronous stop request (motor stop B: 0210h) to the slave CPU 605 in paper leading edge conveyance position processing (S732) and registration stop request processing (S742). That is, the sub-master CPU 601 functions as an asynchronous operation instruction unit which instructs the second lower layer control unit to operate asynchronously to the first lower layer control unit when the second sensing unit senses passage of the leading edge of the medium after the first sensing unit senses passage of the trailing edge of the medium. When a count completion event of the motor 609 arrives at the sub-master CPU 601 from the slave CPU 605, the paper leading edge position is updated (S731), and the paper sheet undergoes registration stop. When a registration ON operation request arrives from the master CPU 1001, registration ON operation processing (S718) is executed, and a motor asynchronous start request (motor start B: 0110h) is sent to the slave CPU 605, thereby performing a registration ON operation for the paper sheet.

According to this embodiment, it is decided whether synchronous driving or asynchronous driving is to be performed, in accordance with whether paper sheet conveyance by a single slave CPU or by a plurality of slave CPUs is to be performed (that is, whether the size of the paper sheet is not less than a predetermined threshold). In general, to allow a plurality of slave CPUs to operate in synchronization with each other, a synchronous conveyance command, a response to this command, and a command for sending information on the synchronization timing must be communicated between each slave CPU and the sub-master CPU. On the other hand, to convey a medium with a size that can be conveyed asynchronously, a command for issuing an asynchronous conveyance instruction need only be sent to a slave CPU which engages with conveyance. Hence, the communication traffic can be greatly reduced as a whole by switching synchronous conveyance and asynchronous conveyance from one to the other in accordance with the size of the medium. This would obviate the need for a high-speed network. This makes it possible not only to lower the cost of the communication path but also to reduce the communication delay, so the conveyance accuracy improves.

The size of the medium may be specified indirectly or implicitly instead of being specified directly. When the registration sensor 256 detects the leading edge after the paper feed sensor 247 detects the trailing edge, a medium with a size equal to or larger than a predetermined threshold is being conveyed, as has been described with reference to FIGS. 11A to 12B. On the other hand, if the registration sensor 256 detects the leading edge before the paper feed sensor 247 detects the trailing edge, a medium with a size smaller than the predetermined threshold is being conveyed. In other words, the size of the paper sheet is effectively specified by monitoring the detection results obtained by a plurality of sensors even without acquiring data of the medium size. Note that the size of the paper sheet need not always be specified by this processing. This is because the leading and trailing edge positions in the conveyance path can be determined based on the detection results output from the sensors which detect passage of the leading and trailing edges of the paper sheet in the conveyance path. As long as the leading and trailing edge positions of the paper sheet can be specified, the sub-master CPU can decide whether this paper sheet is to be conveyed by a plurality of slave CPUs synchronously or asynchronously to each other. Information indicating whether synchronous or asynchronous conveyance is to be performed may be tabulated in association with combinations of the leading and trailing edge positions, and be held in, for example, a ROM.

Second Embodiment

In the first embodiment, synchronization timing notification is implemented by sending a synchronous operation command via the local communication lines 450. An example in which synchronization timing notification is performed via general-purpose ports will be described in the second embodiment.

<Control Block of Sub-Master CPU>

Figure 13:
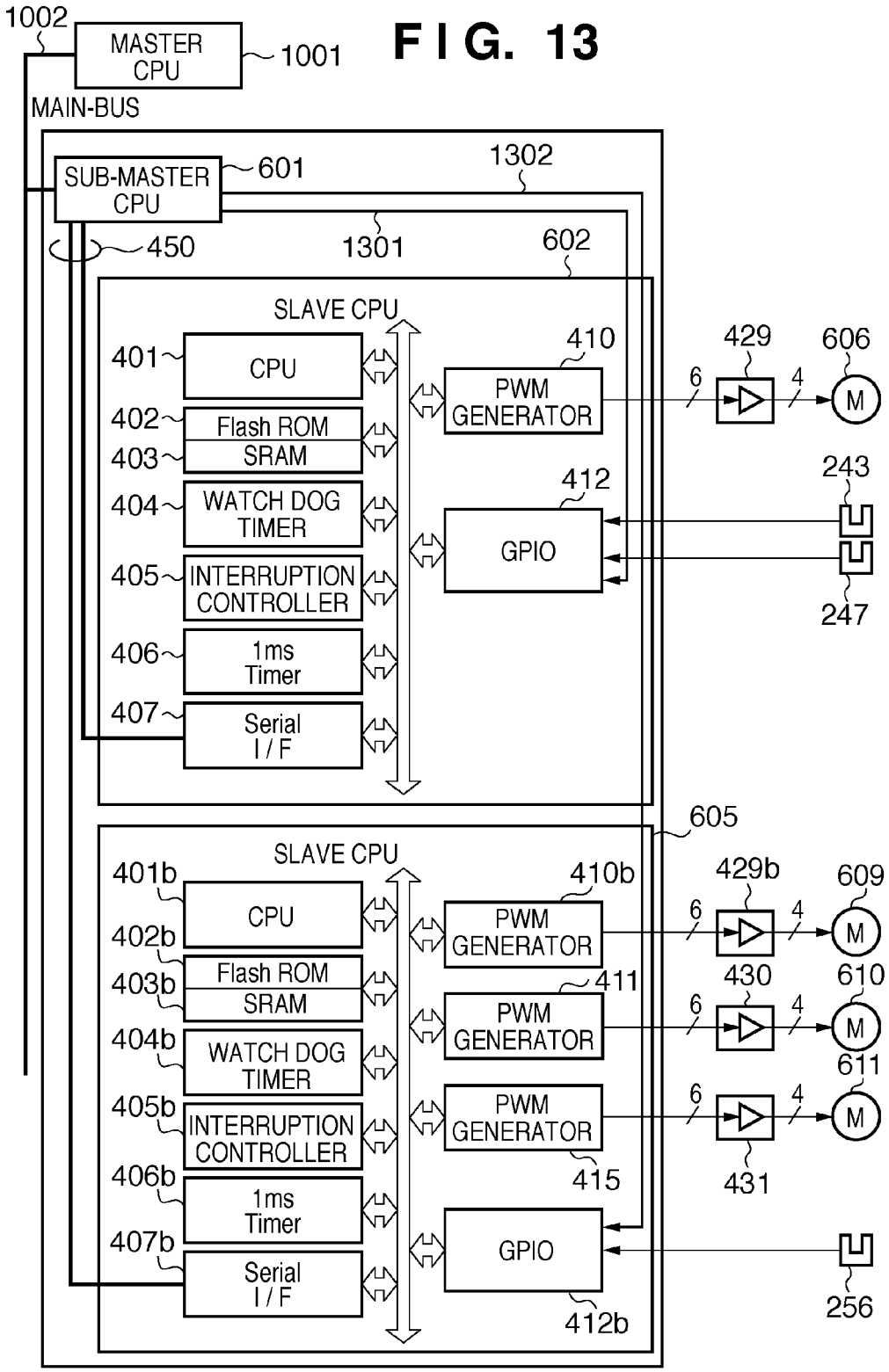
FIG. 13 is a control block diagram of a sub-master CPU 601.

FIG. 13 shows a control block of a sub-master CPU 601. For the sake of descriptive simplicity, the same reference numerals as in FIG. 4 denote parts common to those in FIG. 13. In the second embodiment, the sub-master CPU 601 and a GPIO 412 of each slave CPU are connected to each other via synchronization signal lines 1301 and 1302, each of which serves as a single signal line which transmits a synchronization signal for notifying these slave CPUs of the synchronization timing. In other words, output ports, which are connected to the synchronization signal lines 1301 and 1302, among the output ports of the sub-master CPU 601 are set as synchronization signal output ports. The synchronization signal lines 1301 and 1302 exemplify second communication paths to transmit a synchronization signal indicating the synchronization timing from an upper layer control unit to a first lower layer control unit and second lower layer control unit.

Figure 14:
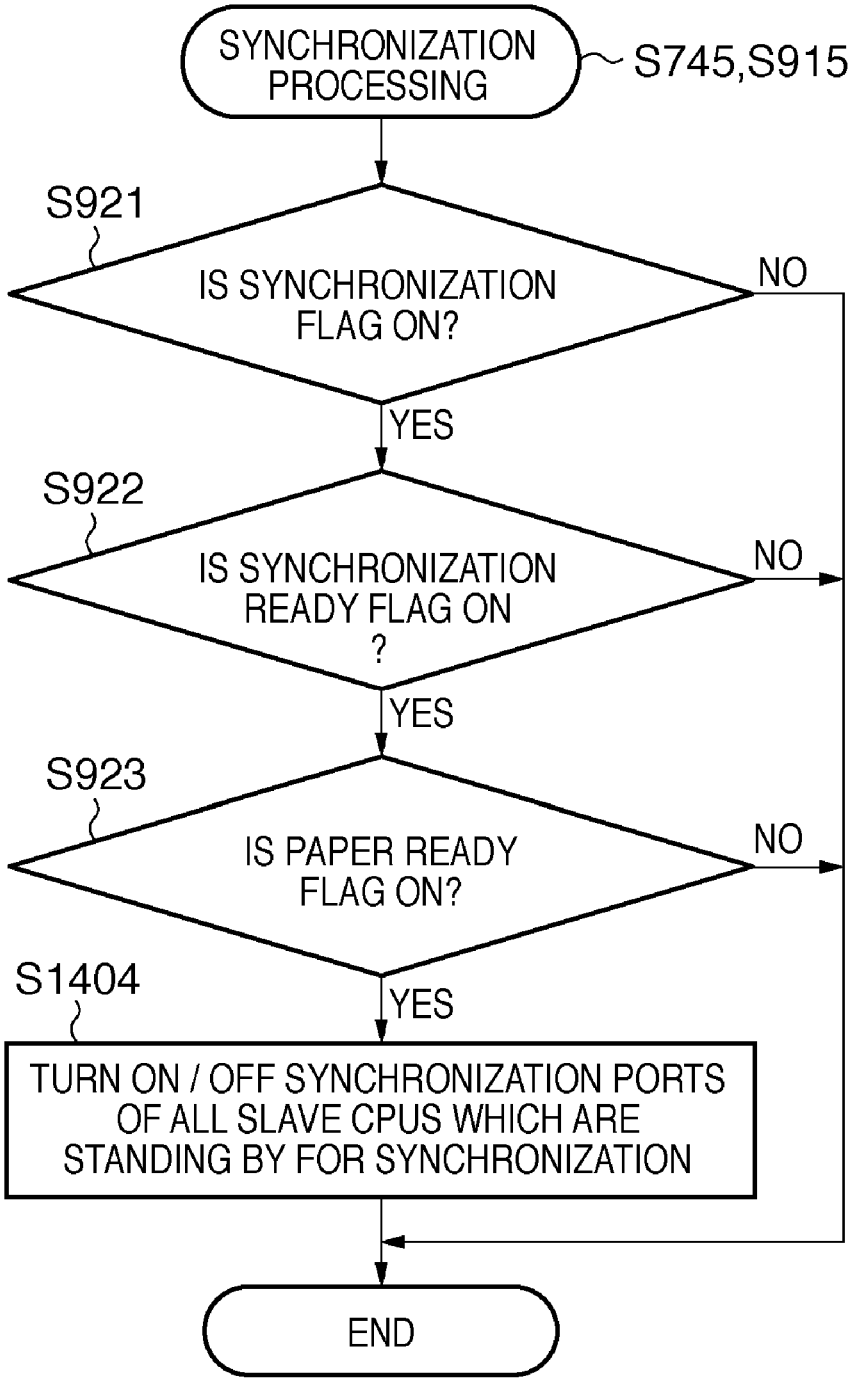
FIG. 14 is a flowchart showing synchronization processing.

FIG. 14 shows details of synchronization processing of the sub-master CPU 601 in the second embodiment. A description of parts common to those in the first embodiment will not be given. If all of the synchronization flag, the synchronization ready flag, and the paper ready flag are ON, the process advances to step S1404. In step S1404, the sub-master CPU turns on/off synchronization signal output ports corresponding to all slave CPUs to which a motor synchronous stop request has been issued in step S904.

Figure 15A:
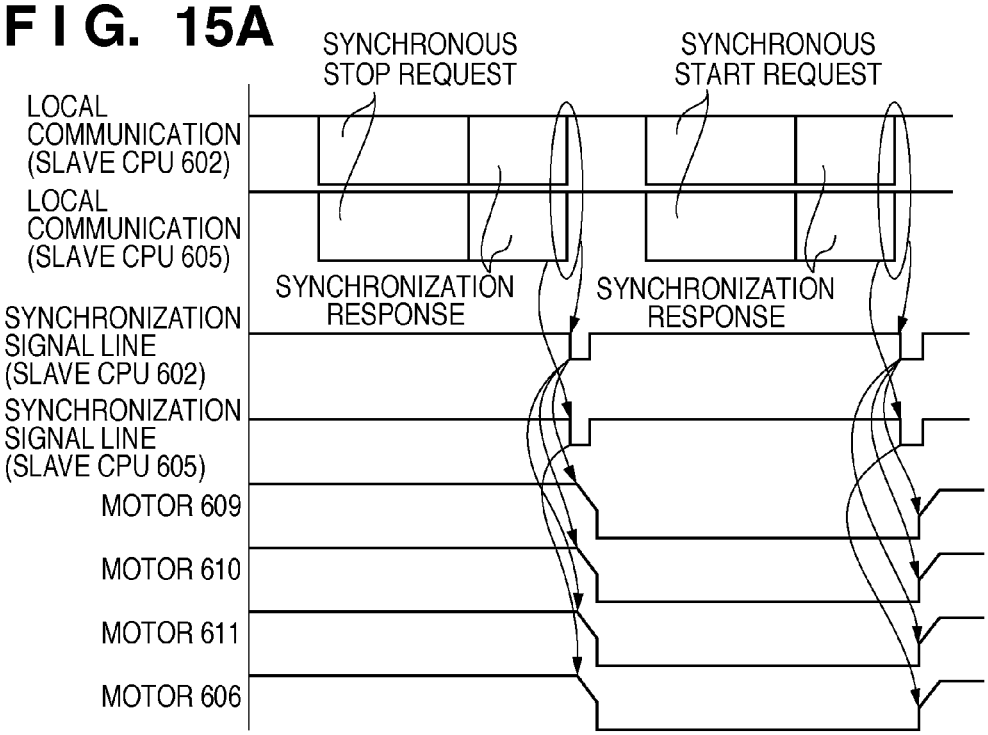
FIG. 15A shows a timing chart of position correction.
Figure 15B:
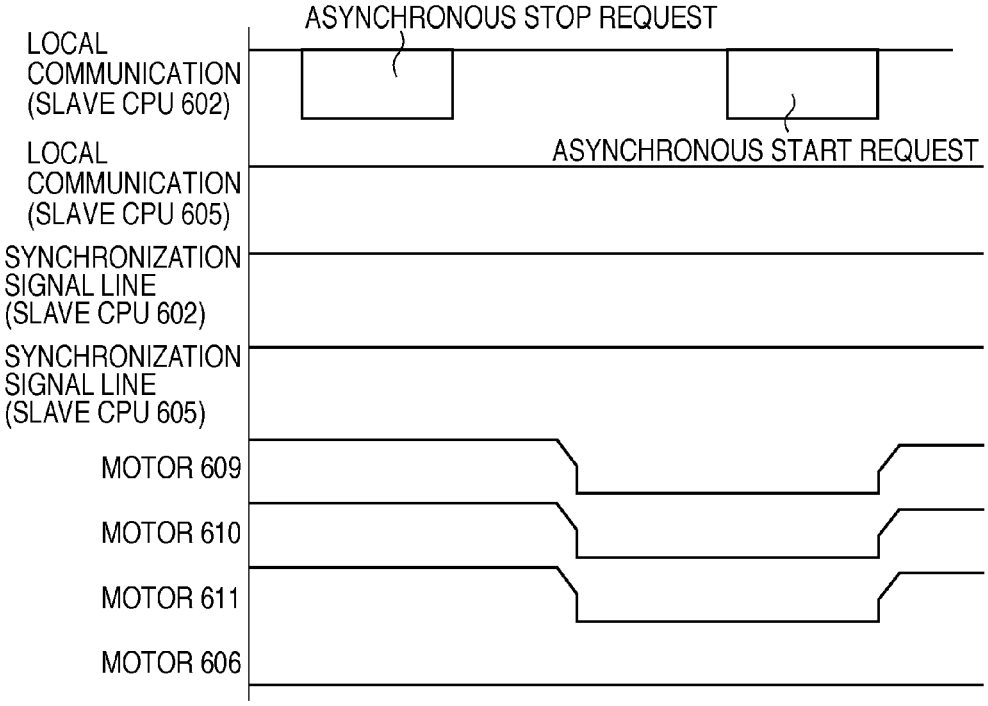
FIG. 15B shows a timing chart of a registration ON operation.

FIGS. 15A and 15B are timing charts of position correction (registration stop) and a registration ON operation, respectively, in the second embodiment. FIG. 15A illustrates especially an example of large-sized paper (synchronous driving). After a synchronous stop request and synchronization responses are sent/received via local communication lines 450, the sub-master CPU 601 sets the synchronization signal output ports connected to the synchronization signal lines 1301 and 1302 to Low. Slave CPUs 602 and 605 use, for example, interruption controllers to monitor the input ports of GPIOs connected to the synchronization signal lines 1301 and 1302. When the slave CPUs 602 and 605 detect synchronization ON, they stop motors 606, and 609, 610 and 611, respectively, based on the reception of a synchronous stop request. After a synchronous start request and synchronization responses are sent/received via the local communication lines 450, the sub-master CPU 601 switches the output ports connected to the synchronization signal lines 1301 and 1302 to Low. When the slave CPUs 602 and 605 detect synchronization ON, they start the motors 606, and 609, 610 and 611, respectively, based on the reception of a synchronous start request. In this manner, the slave CPUs can be notified of the synchronization timing by adding the synchronization signal lines 1301 and 1302. This makes it possible to further reduce the communication traffic in the local communication line 450.

FIG. 15B illustrates an example of small-sized paper (asynchronous driving). After an asynchronous stop request is sent/received via the local communication line 450, the slave CPU 605 stops the motors 609, 610, and 611 based on the reception of an asynchronous stop request. Furthermore, after an asynchronous start request is sent/received via the local communication line 450, the slave CPU 605 starts the motors 609, 610, and 611 based on the reception of an asynchronous start request. Hence, the second embodiment can exhibit the same effect as in the first embodiment. Also, the communication traffic in the local communication line 450 can further be reduced in the second embodiment, as compared with the first embodiment. Because a signal line which simply transmits a synchronization signal can be basically implemented at a low cost, the second embodiment is more advantageous to further reduce the communication traffic in the local communication line 450. Although a serial communication line has been assumed as the local communication line 450 serving as a first communication path, the local communication line 450 may be implemented by radio communication.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-083398, filed Mar. 31, 2010, which is hereby incorporated by reference herein in its entirety.

What is claimed is:

1. A medium conveyance apparatus comprising:

a conveyance path to convey a medium;

a plurality of conveyance units which convey the medium along the conveyance path;

a first lower layer control unit which controls a conveyance unit, that conveys the medium in a first conveyance section of the conveyance path, among the plurality of conveyance units;

a second lower layer control unit which controls a conveyance unit, that conveys the medium in a second conveyance section located downstream of the first conveyance section in a direction in which the medium is conveyed, among the plurality of conveyance units;

an upper layer control unit which controls the first lower layer control unit and the second lower layer control unit; and a passage detection unit which is provided in the conveyance path, and detects passage of the medium, wherein the upper layer control unit is further configured to determine, in accordance with the detection result obtained by the passage detection unit, whether the medium is at a position where both the first lower layer control unit and the second lower layer control unit engage with conveyance control of the medium, instruct the first lower layer control unit and the second lower layer control unit to operate in synchronization with each other when the upper layer control unit determines that the medium is at the position where both the first lower layer control unit and the second lower layer control unit engage with the conveyance control of the medium, and instruct the second lower layer control unit to operate asynchronously to the first lower layer control unit when the upper layer control unit determines that the medium is not at the position where both the first lower layer control unit and the second lower layer control unit engage with the conveyance control of the medium.

2. The apparatus according to claim 1, wherein the passage detection unit includes a plurality of passage detection units including a first sensing unit which senses passage of a leading edge and trailing edge of the medium conveyed in the first conveyance section, and a second sensing unit which senses passage of the leading edge and trailing edge of the medium conveyed in the second conveyance section, and wherein the upper layer control unit is further configured to instruct the first lower layer control unit and the second lower layer control unit to operate in synchronization with each other when the second sensing unit senses passage of the leading edge of the medium before the first sensing unit senses passage of the trailing edge of the medium after the first sensing unit senses passage of the leading edge of the medium, and instruct the second lower layer control unit to operate asynchronously to the first lower layer control unit when the second sensing unit senses passage of the leading edge of the medium after the first sensing unit senses passage of the trailing edge of the medium.

3. The apparatus according to claim 1, wherein the upper layer control unit is further configured to send, to the first lower layer control unit and the second lower layer control unit via a first communication path, a synchronize request command indicating that the conveyance units controlled by the first lower layer control unit and the second lower layer control unit, respectively, are to be stopped or started in synchronization with each other, and a synchronization command indicating a timing of the synchronization after receiving responses to the synchronize request command, and send, to the second lower layer control unit via the first communication path, an asynchronous operation command indicating that the conveyance units controlled by the first lower layer control unit and the second lower layer control unit, respectively, operate asynchronously to each other.

4. The apparatus according to claim 1, further comprising a second communication path to transmit a synchronization signal indicating a timing of the synchronization from the upper layer control unit to the first lower layer control unit and the second lower layer control unit, wherein the upper layer control unit is further configured to send, to the first lower layer control unit and the second lower layer control unit via a first communication path, a synchronize request command indicating that the conveyance units controlled by the first lower layer control unit and the second lower layer control unit, respectively, are to be stopped or started in synchronization with each other, and a synchronization command indicating a timing of the synchronization after receiving responses to the synchronize request command, and send, to the second lower layer control unit via the first communication path, an asynchronous operation command indicating that the conveyance unit controlled by the second lower layer control unit is to be stopped or started asynchronously to the conveyance unit controlled by the first lower layer control unit.

5. The apparatus according to claim 4, wherein the first communication path is a serial communication line, and the second communication path is a single signal line.

6. An image forming apparatus comprising:

a medium conveyance apparatus; and an image forming unit which forms an image on a medium conveyed by the medium conveyance apparatus, wherein the medium conveyance apparatus comprises a conveyance path to convey a medium, a plurality of conveyance units which convey the medium along the conveyance path, a first lower layer control unit which controls a conveyance unit, that conveys the medium in a first conveyance section of the conveyance path, among the plurality of conveyance units, a second lower layer control unit which controls a conveyance unit, that conveys the medium in a second conveyance section located downstream of the first conveyance section in a direction in which the medium is conveyed, among the plurality of conveyance units, an upper layer control unit which controls the first lower layer control unit and the second lower layer control unit, and a passage detection unit which is provided in the conveyance path, and detects passage of the medium, wherein the upper layer control unit is further configured to determine, in accordance with the detection result obtained by the passage detection unit, whether the medium is at a position where both the first lower layer control unit and the second lower layer control unit engage with conveyance control of the medium, instruct the first lower layer control unit and the second lower layer control unit to operate in synchronization with each other when the upper layer control unit determines that the medium is at the position where both the first lower layer control unit and the second lower layer control unit engage with the conveyance control of the medium, and instruct the second lower layer control unit to operate asynchronously to the first lower layer control unit when the upper layer control unit determines that the medium is not at the position where both the first lower layer control unit and the second lower layer control unit engage with the conveyance control of the medium.

* * * * *